US005353523A

United States Patent [19]

Kilgore et al.

[11] Patent Number: 5,353,523

[45] Date of Patent: Oct. 11, 1994

[54] SHOE WITH AN IMPROVED MIDSOLE

[75] Inventors: Bruce J. Kilgore, Lake Oswego, Oreg.; Thomas McMahon, Wellesley, Mass.; John C. Tawney, Portland; Gordon Valiant, Beaverton, both of Oreg.

[73] Assignee: Nike, Inc., Beaverton, Oreg.

[21] Appl. No.: 134,886

[22] Filed: Oct. 13, 1993

Related U.S. Application Data

[62] Division of Ser. No. 738,031, Aug. 2, 1991, abandoned.

[51] Int. Cl.[5] ..... A43B 13/20; A43B 21/28; A43B 13/18

[52] U.S. Cl. ..... 36/29; 36/28; 36/35 B

[58] Field of Search ..... 36/27, 28, 29, 35 R, 36/35 B, 7.8, 37, 38; 5/481

[56] References Cited

U.S. PATENT DOCUMENTS

| | | | |
|---|---|---|---|
| 507,490 | 10/1893 | Gambino . | |
| 622,673 | 4/1899 | Ferrata . | |
| 933,422 | 9/1909 | Dee . | |
| 949,754 | 2/1910 | Busky . | |
| 1,094,211 | 4/1914 | Jenoi et al. . | |
| 1,099,180 | 6/1914 | Karacsonyi | 36/38 |
| 1,102,343 | 7/1914 | Kovacs . | |
| 1,272,490 | 7/1918 | Matear . | |
| 1,278,320 | 9/1918 | Ellithorpe . | |
| 1,328,816 | 1/1920 | Brown . | |
| 1,338,817 | 5/1920 | De Luca . | |
| 1,502,087 | 7/1924 | Bunns | 36/28 |
| 1,670,747 | 5/1928 | Sestito . | |
| 1,870,065 | 8/1932 | Nusser . | |
| 2,104,924 | 1/1938 | Dellea . | |
| 2,122,108 | 6/1938 | Modlin . | |
| 2,299,009 | 10/1942 | Denk . | |
| 2,710,460 | 6/1955 | Stasinos . | |
| 2,771,400 | 10/1955 | Israel . | |
| 3,041,746 | 7/1962 | Rakus . | |
| 3,429,545 | 2/1969 | Michel . | |
| 3,822,490 | 7/1974 | Murawski . | |
| 4,030,213 | 6/1977 | Daswick . | |
| 4,074,446 | 2/1978 | Eisenberg . | |
| 4,223,457 | 9/1980 | Borgeas . | |
| 4,237,625 | 12/1980 | Cole et al. . | |
| 4,241,523 | 12/1980 | Daswick . | |

(List continued on next page.)

FOREIGN PATENT DOCUMENTS 806647 1/1949 Fed. Rep. of Germany .

(List continued on next page.)

OTHER PUBLICATIONS

Elastocell TM Microcellular Polyurethane Products, Technical Information, Elastocell TM, a Means for Antivibration and Sound Isolation.

(List continued on next page.)

*Primary Examiner*—Paul T. Sewell
*Assistant Examiner*—Ted Kavanaugh
*Attorney, Agent, or Firm*—Banner, Birch, McKie & Beckett

[57] ABSTRACT

The invention is directed to a midsole for a shoe including one or more foam columns disposed between an upper and a lower plate. One or more elastomeric foam elements are disposed between the upper and lower plates. The foam elements are made of a material such as microcellular polyurethane-elastomer based on a polyester-alcohol and naphthalene-diisocyanate (NDI). In one embodiment, the foam, elements have the shape of hollow cylindrical columns, and may include grooves formed on the exterior surface. One or more elastic rings are disposed about the columns and are removably disposable in the grooves, allowing the stiffness of the columns to be adjusted. In a further embodiment, inflatable gas bladders are disposed in the hollow regions. The heights of the gas bladders may be less than the heights of the columns such that when the midsole is compressed, the wearer experiences a first stiffness corresponding to compression of the columns alone, and a second stiffness corresponding to compression of both the columns and the bladders. Alternatively, the bladders may be inflated so as to cause the columns to be stretched, even when no load is applied. Since the level of inflation of the bladders may be adjusted, the overall stiffness of the midsole may be tuned to the individual requirements of the wearer.

18 Claims, 21 Drawing Sheets

U.S. PATENT DOCUMENTS

| | | | |
|---|---|---|---|
| 4,262,433 | 4/1981 | Hagg et al. . | |
| 4,267,648 | 5/1981 | Weisz . | |
| 4,271,606 | 6/1981 | Rudy | 36/29 |
| 4,271,607 | 6/1981 | Funck . | |
| 4,314,413 | 2/1982 | Dassler . | |
| 4,319,412 | 3/1982 | Muller et al. . | |
| 4,342,158 | 8/1982 | McMahon et al. . | |
| 4,399,621 | 8/1983 | Dassler . | |
| 4,439,936 | 4/1984 | Clarke et al. . | |
| 4,492,046 | 6/1985 | Kosova . | |
| 4,494,321 | 1/1985 | Lawlor . | |
| 4,536,974 | 8/1985 | Cohen . | |
| 4,546,555 | 10/1985 | Spademan . | |
| 4,559,366 | 12/1985 | Hostettler . | |
| 4,566,206 | 1/1986 | Weber . | |
| 4,592,153 | 6/1986 | Jacinto . | |
| 4,594,799 | 6/1986 | Lin . | |
| 4,598,484 | 7/1986 | Ma . | |
| 4,598,487 | 7/1986 | Misevich . | |
| 4,610,099 | 9/1986 | Signori . | |
| 4,616,431 | 10/1986 | Dassler . | |
| 4,638,575 | 1/1987 | Illustrato . | |
| 4,660,299 | 4/1987 | Omilusik . | |
| 4,670,995 | 6/1987 | Huang | 36/29 |
| 4,680,875 | 7/1987 | Danieli . | |
| 4,680,876 | 7/1987 | Peng . | |
| 4,709,489 | 12/1987 | Welter . | |
| 4,715,130 | 12/1987 | Scatena . | |
| 4,731,939 | 3/1988 | Parracho et al. . | |
| 4,746,555 | 5/1988 | Luckanuck . | |
| 4,753,021 | 6/1988 | Cohen . | |
| 4,763,426 | 8/1988 | Polus et al. . | |
| 4,774,774 | 10/1988 | Allen, Jr. | 36/29 X |
| 4,794,707 | 1/1989 | Franklin et al. . | |
| 4,798,009 | 1/1989 | Colonel et al. . | |
| 4,802,289 | 2/1989 | Guldager | 36/153 X |
| 4,815,221 | 3/1989 | Diaz . | |
| 4,843,737 | 7/1989 | Vorderer . | |
| 4,843,741 | 7/1989 | Yung-Mao . | |
| 4,845,863 | 7/1989 | Yung-Mao . | |
| 4,878,300 | 11/1989 | Bogaty . | |
| 4,881,329 | 11/1989 | Crowley . | |
| 4,887,367 | 12/1989 | Mackness et al. | 36/29 X |
| 4,910,884 | 3/1990 | Lindh et al. . | |
| 4,914,836 | 4/1990 | Horovitz | 36/29 X |
| 4,918,838 | 4/1990 | Chang . | |
| 4,936,029 | 6/1990 | Rudy | 36/71 |
| 4,956,927 | 9/1990 | Misevich et al. . | |
| 4,984,376 | 1/1991 | Walter et al. . | |
| 5,014,449 | 5/1991 | Richard et al. . | |
| 5,068,981 | 12/1991 | Jung . | |
| 5,092,060 | 3/1992 | Frachey et al. | 36/29 |
| 5,138,776 | 8/1992 | Levin . | |
| 5,222,312 | 6/1993 | Doyle | 36/29 X |

FOREIGN PATENT DOCUMENTS

| | | |
|---|---|---|
| 3400997 | 7/1985 | Fed. Rep. of Germany . |
| 0465267 | 4/1914 | France . |
| 1227420 | 4/1960 | France . |
| 2556118 | 6/1985 | France . |
| 146188 | 11/1990 | Japan . |
| 1526637A1 | 12/1989 | U.S.S.R. . |
| 21594 | of 1903 | United Kingdom . |
| 7163 | of 1906 | United Kingdom . |
| 2032761A | 5/1980 | United Kingdom . |
| 2032761 | 5/1980 | United Kingdom . |
| 2173987A | 10/1986 | United Kingdom . |

OTHER PUBLICATIONS

Elastocell TM Microcellular Polyurethane Products, Technical Bulletin, Spring and Damping Elements made from Elastocell.

Elastocell TM Microcellular Polyurethane Products, Material Data Technical Information, Long Term Static and Dynamic Loading of Elastocell.

FWN, vol. 40, No. 38, Sep. 17, 1990, "Marco Scatena puts spring in Athlon wearers' control".

35015 SAE Technical Paper Series, "Microcellular Polyurethane Elastomers as Damping Elements in Automotive Suspension Systems", by Christoph Prolingheuer and P. Henrichs, International Congress and Exposition, Detroit, Michigan, Feb. 25–Mar. 1, 1991.

Spring and Shock Absorber Bearing Spring Elements, Springing Comfort with High Damping.

SHOE WITH AN IMPROVED MIDSOLE

This application is a division, of application Ser. No. 07/738,031, filed Aug. 2, 1991, now abandoned.

BACKGROUND OF THE INVENTION

1. Field of the Invention

The present invention relates to footwear, and more particularly, to an athletic shoe having improved cushioning and stability.

2. Description of the Prior Art

It is known in the prior art to provide athletic shoes with a midsole made from a foam material, such as polyurethane, designed to provide for cushioning against impact, that is, attenuation of the applied load. The polyurethane materials which have been used are non-microcellular, having a non-uniform cell structure. These foam materials have a stiffness (k) which varies in dependence upon the applied load. At lower loads, the foam material is only slightly compressed, and has a low stiffness. As the applied load increases, the compression of the cushioning material increases as well, increasing the stiffness. Eventually, the cushioning material will be compressed to a maximum level such that a further increase in the applied load will not cause the material to be further compressed. At this point, for purposes of the maximum loads applied to midsoles, the stiffness of the material will approach an infinite level, that is, effectively no cushioning will be provided.

In general, during footstrike, the initial contact is made at the rearfoot lateral location, with the foot rolling towards the forward or anterior, and medial locations. The applied load increases until the maximum load is achieved, generally beneath the calcaneous. Since the magnitude and location of the applied load are not constant, it has been difficult to construct the midsole to provide a desired level of cushioning throughout the ground support phase, which includes the breaking phase and the propulsion phase, by using conventional non-microcellular polyurethane foam cushioning materials.

For example, a midsole having a predetermined thickness and therefore stiffness (at a given load) could be utilized. The stiffness may be appropriate for the range of loads experienced at the lateral rear of the shoe during footstrike. That is, at that location, the load may not exceed a level which causes maximum compression. However, at the location beneath the calcaneus, the load may exceed this level, the stiffness will approach infinity, and the wearer will experience a sudden loss of cushioning known as bottoming-out. Alternatively, if the material and thickness are designed to compensate for the maximum load, the initial stiffness experienced at the lateral rear will be too high. In addition, the thickness of such midsoles increases the weight of the shoe and reduces rearfoot stability, precluding their use in athletic shoes.

Furthermore, in prior art shoes, a particular level of midsole stiffness would be selected for a given shoe based upon the likely weight of a person wearing a given shoe size, and perhaps, the loads expected to be produced during the activity for which the shoe is designed. However, the midsole stiffness could not be adjusted to take into account weight variations between people having the same shoe size. In addition, even if a stiffness were achieved which was appropriate for a given wearer performing a given activity, the stiffness could not be adjusted so as to provide an appropriate level for other activities having a different range of expected loads. For example, if a shoe were designed for running, even if the stiffness was appropriate for the weight of an "average" person having a particular shoe size, it would have a stiffness which was greater than desired for the loads expected during walking by the same "average" weight person. In addition, the shoe would be either overcushioned or undercushioned for a person having a smaller or greater than average weight, respectively.

SUMMARY OF THE INVENTION

The present invention is directed to a shoe having an upper and a sole connected to the upper. The sole includes a midsole comprising one or more support elements made from a microcellular polyurethane-elastomer foam material. Suitable foam materials include microcellular NDI, microcellular MDI and microcellular TODI.

In a further embodiment, the midsole includes an envelope having an upper and lower plate, with the support elements disposed between the upper and lower plates.

In a further embodiment, the support elements include a plurality of hollow columns, with two of the columns disposed on each side of the sagittal plane of the shoe. The columns may have a hollow cylindrical shape.

In a further embodiment, an insert is disposed within each of the foam columns. The inserts have a height which is substantially less than the height of the column. The inserts may be gas-filled bladders, which may be adjustably inflatable. In a further embodiment, the gas-filled bladders may be inflated so as to stretch or distend the foam support element.

In a further embodiment the foam support elements include at least one annular groove disposed in the outer surface at one or more vertical positions. An elastic ring element is disposed about the support elements and is movable in the vertical direction so as to be removably disposable in the groove. The stiffness of the support elements is adjustable by selectively positioning the ring element into or out of the groove.

The present invention provides the advantage of allowing the stiffness of the midsole to correspond to the applied load as the load changes throughout the ground support phase. Overcushioning, undercushioning and bottoming-out are eliminated. Furthermore, the cushioning may be tuned to suit different wearer weights, and the use of the shoe for activities having different load ranges.

DETAILED DESCRIPTION OF THE PREFERRED EMBODIMENTS

Figure 1:
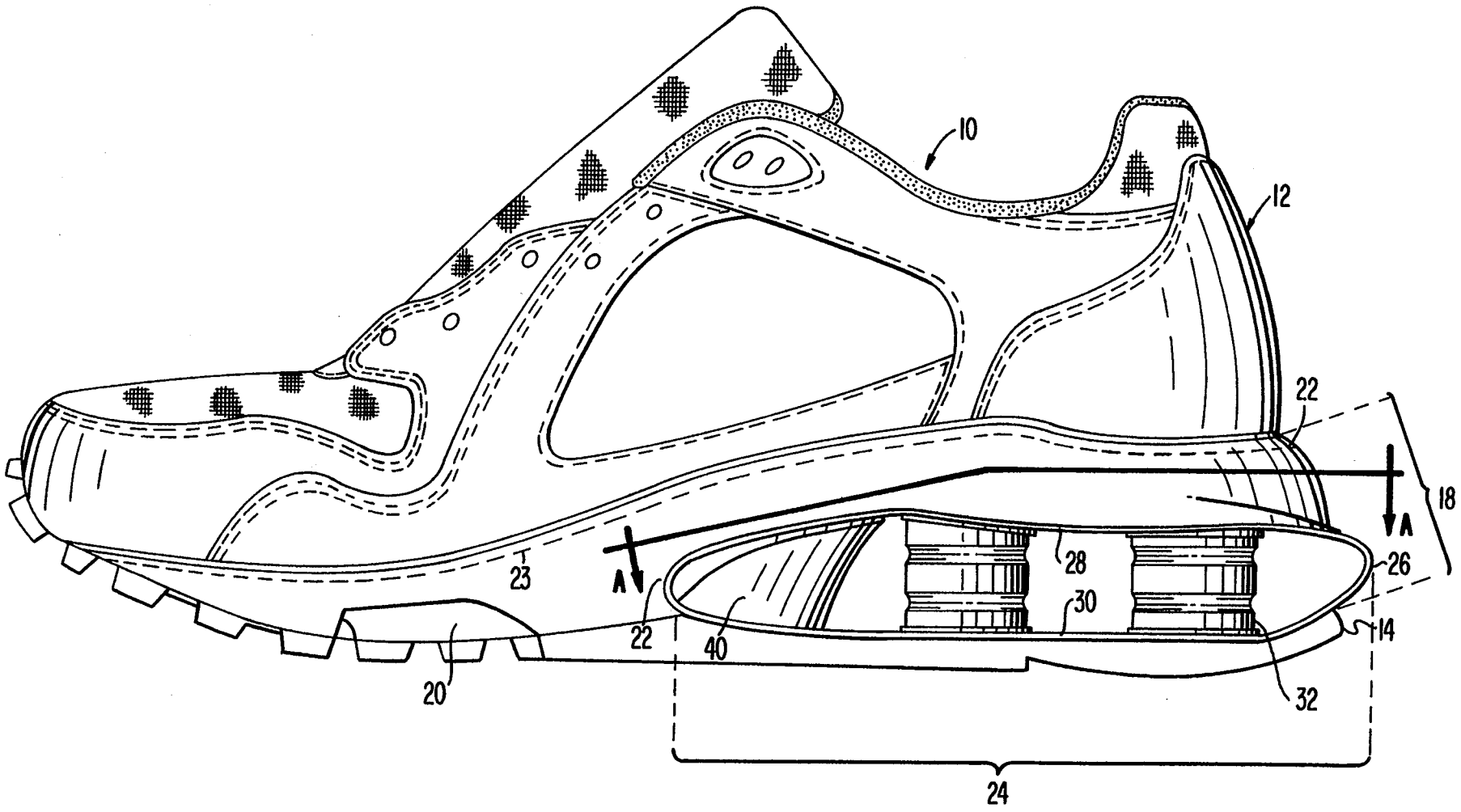
FIG. 1 is a lateral view of a shoe including a midsole according to the present invention.

With reference to FIG. 1, a shoe including a midsole according to the present invention is disclosed. Shoe 10 includes conventional upper 12 attached in a conventional manner to sole 14. Sole 14 includes midsole 18, and conventional outsole layer 20 formed of a conventional wear-resistant material such as a carbon-black rubber compound. Midsole 18 includes footframe 23, cushioning and stability component 24, midfoot wedge 40 and cushioning layer 22 made of a conventional cushioning material such as ethyl vinyl acetate (E.V.A) or conventional non-microcellular polyurethane (PU) foam extending substantially throughout at least the forefoot portion of shoe 10.

Figure 9A:
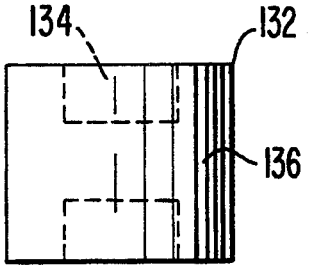
FIGS. 9*a*–9*f* are views of support elements according to further embodiments of the invention.

Midsole 18 includes cushioning and stability component 24 extending rearwardly approximately from the forefoot to a location adjacent the posterior portion of cushioning layer 22. Cushioning and stability component 24 includes shell or envelope 26 having upper and lower plates 28 and 30, and a plurality of compliant elastomeric support elements 32 disposed therebetween. In a preferred embodiment, elements 32 have the shape of hollow cylindrical columns as shown in FIGS. 5*a*–5*d*, or partitioned columns, that is, hollow columns with cavities extending inwardly from each planar end surface, as shown in FIG. 9*a*.

Shell 26 may be made from nylon or other suitable materials such as BP8929-2 RITEFLEX TM, a polyester elastomer manufactured by Hoechst-Celanese of Chatham, N.J., or a combination of nylon having glass mixed therewith, for example, nylon with 13% glass. Other suitable materials would include materials having a moderate flexural modulus that is, semi-rigid, and exhibiting high resistance to flexural fatigue. Support elements 32 are made from a material comprising a microcellular polyurethane, for example, a microcellular polyurethane-elastomer based on a polyester-alcohol and naphthalene-1,5-diisocyanate (NDI), such as the elastomeric foam material manufactured and sold under the name ELASTOCELL TM by BASF Corporation of Wyandotte, Mich. Other suitable polyurethane materials such as a microcellular polyurethane-elastomer based on a polyester-alcohol and methylenediphenylene-4,4'-diisocyanate (MDI) and a microcellular polyurethane-elastomer based on a polyester-alcohol and bitolyene (TODI) may be used. These materials exhibit a substantially uniform cell structure and small cell size as compared to the non-microcellular polyurethanes which have been used in the prior art.

By utilizing microcellular polyurethanes, several advantages are obtained. For example, microcellular polyurethanes are more resilient, and thereby restore more of the input energy imparted during impact than non-microcellular polyurethanes. Furthermore, microcellular polyurethanes are more durable. This latter fact combined with the fact that the deflection of a foam column made from microcellular polyurethanes is more predictable than for non-microcellular polyurethanes allows the midsole to be constructed so as to selectively distribute and attenuate the impact load. This distribution of the load results in a midsole which provides a desirable level of cushioning thoughout a ground support phase, without overcushioning or undercushioning at any location. These advantages are explained further below.

Figure 18A:
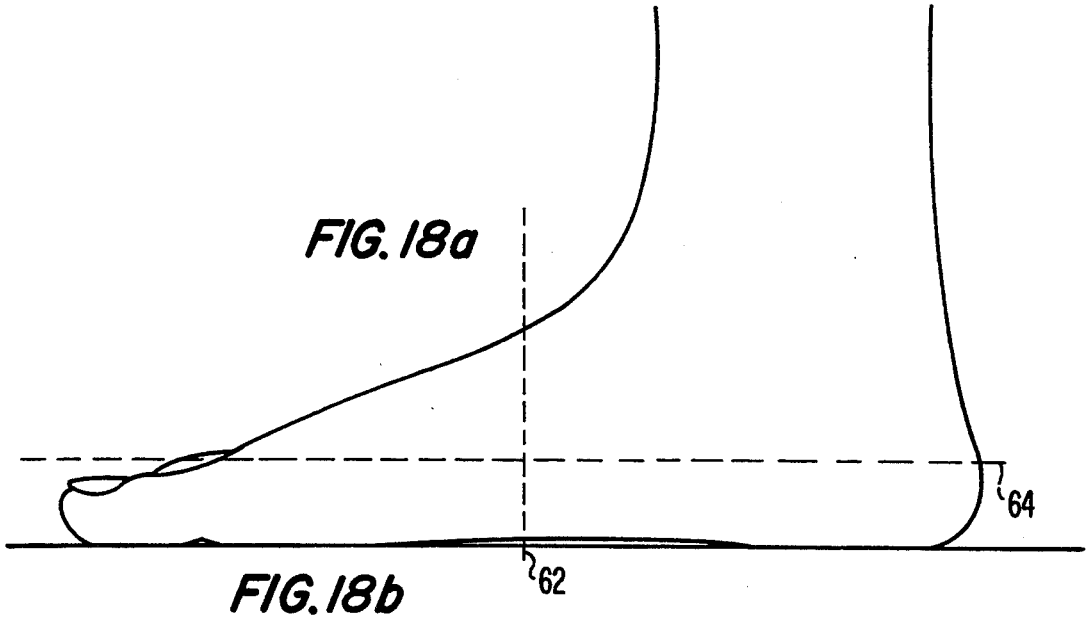
FIG. 18*a* is a lateral view of the foot, showing the various planes thereof.
Figure 18B:
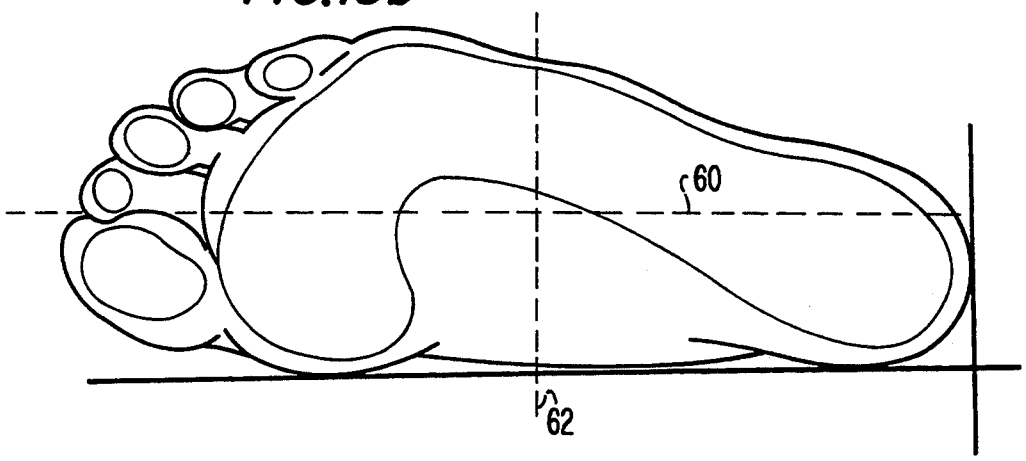
FIG. 18*b* is an underside view of the foot, showing the various planes thereof.

With reference to FIGS. 18*a* and 18*b*, various planes are shown with reference to a foot. Reference to these planes as applied to a shoe and the axes defined thereby will be made throughout the description. The sagittal plane is the vertical plane that passes through the shoe from back to front and top to bottom, dividing it into a medial and lateral half and is shown as reference numeral 60. The frontal plane is the vertical plane that passes through the shoe from top to bottom and side to side dividing it into anterior and posterior halves, and is shown as reference numeral 62. The transverse plane is the horizontal plane that passes through the body from side to side and back to front dividing it into an upper and lower half, and is shown as reference numeral 64. The anterior-posterior axis is the intersection of the transverse and sagittal planes. The superior-inferior axis is the intersection of the sagittal and frontal planes. The medial-lateral axis is the intersection of the transverse and frontal planes.

Figure 2A:
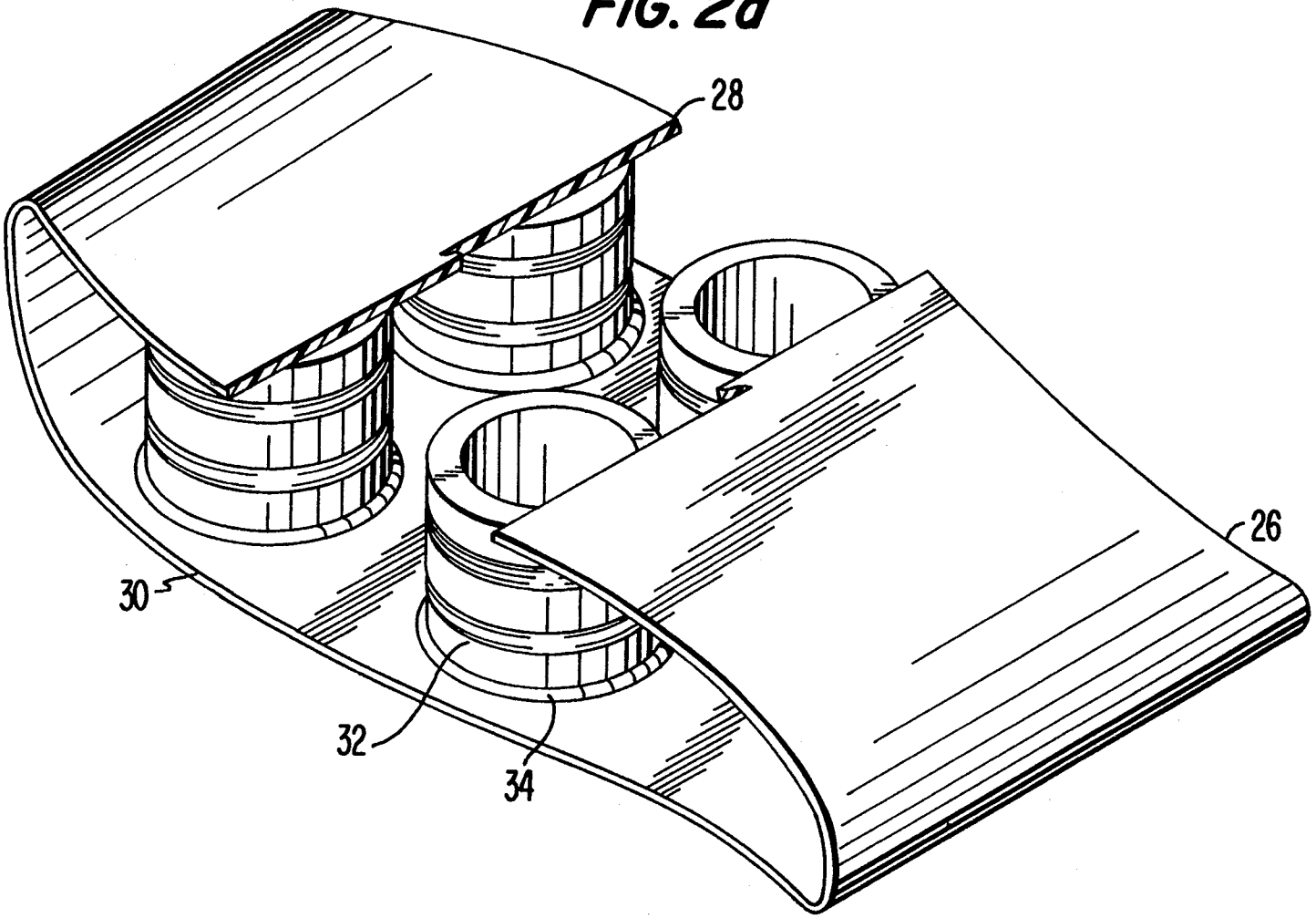
FIGS. 2*a*–2*c* are perspective views of a cushioning and stability component including a shell according to three embodiments, respectively, of the present invention.
Figure 3B:
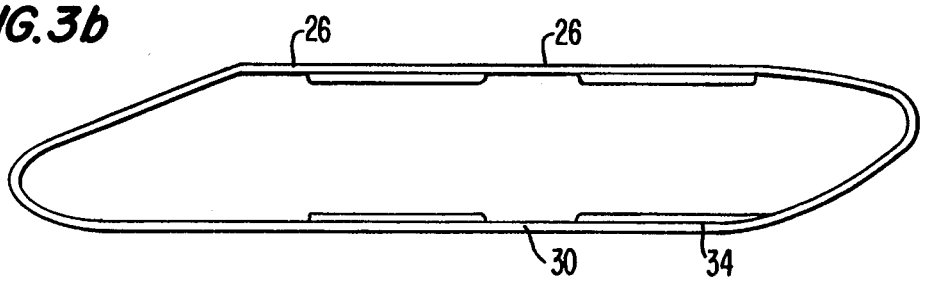
FIG. 3*b* is a side view of the shell shown in FIG. 3*a*.
Figure 3A:
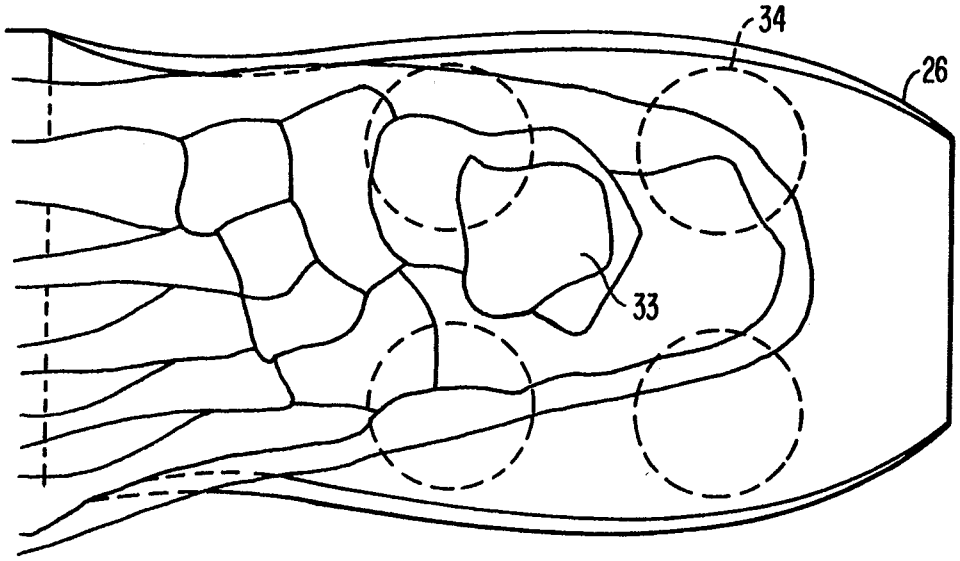
FIG. 3*a* is an overhead view of the shell shown in FIG. 2 and including the rear foot bones superimposed thereon.
Figure 3C:
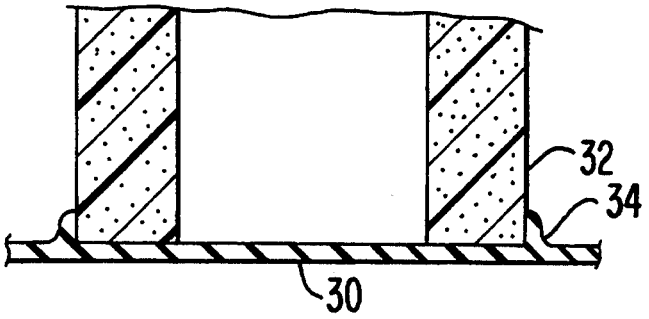
FIG. 3*c* is a close-up view of a support element shown in a detent.

With further reference to FIGS. 2*a* and 3*a*–3*b*, shell 26 includes upper and lower plates 28 and 30 which define an interior volume. Shell 26 serves to increase torsional rigidity about the anterior-posterior axis of the shoe. Additionally, shell 26 helps distribute the load between support elements 32, and thereby helps to control foot motion and provide foot stability. In the FIG. 2*a* embodiment, upper and lower plates 28 and 30 are joined such that shell 26 has the shape of a generally closed oval envelope. This embodiment has the advantages of ensuring that all of the columns are loaded substantially axially during footstrike, and of providing a torsional restoring moment to upper plate 28 with respect to lower plate 30 when the foot is everted or inverted. Thus, stability is enhanced, making this embodiment particularly useful in running shoes. In addition, the closed envelope limits the load on the adhesives which secure support elements 32 to shell 26, that is, the drawbacks associated with having only the small surface of the support elements for use as adhesive surfaces are avoided. Midfoot wedge 40 is disposed at the front of shell 26 and prevents total collapse of the shell structure at this region, which would cause a loss of midfoot support.

Figure 2B:
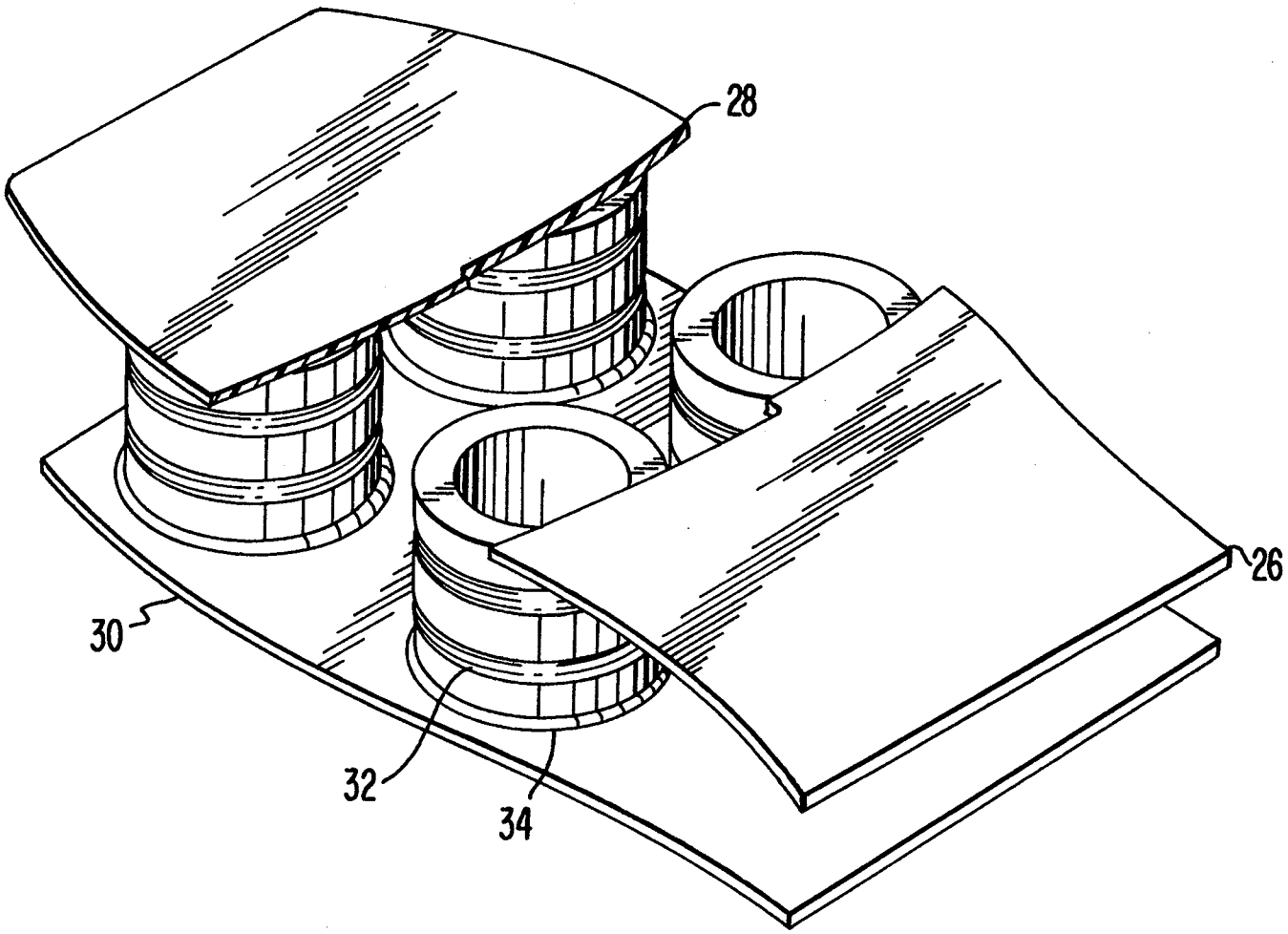
Figure 2C:
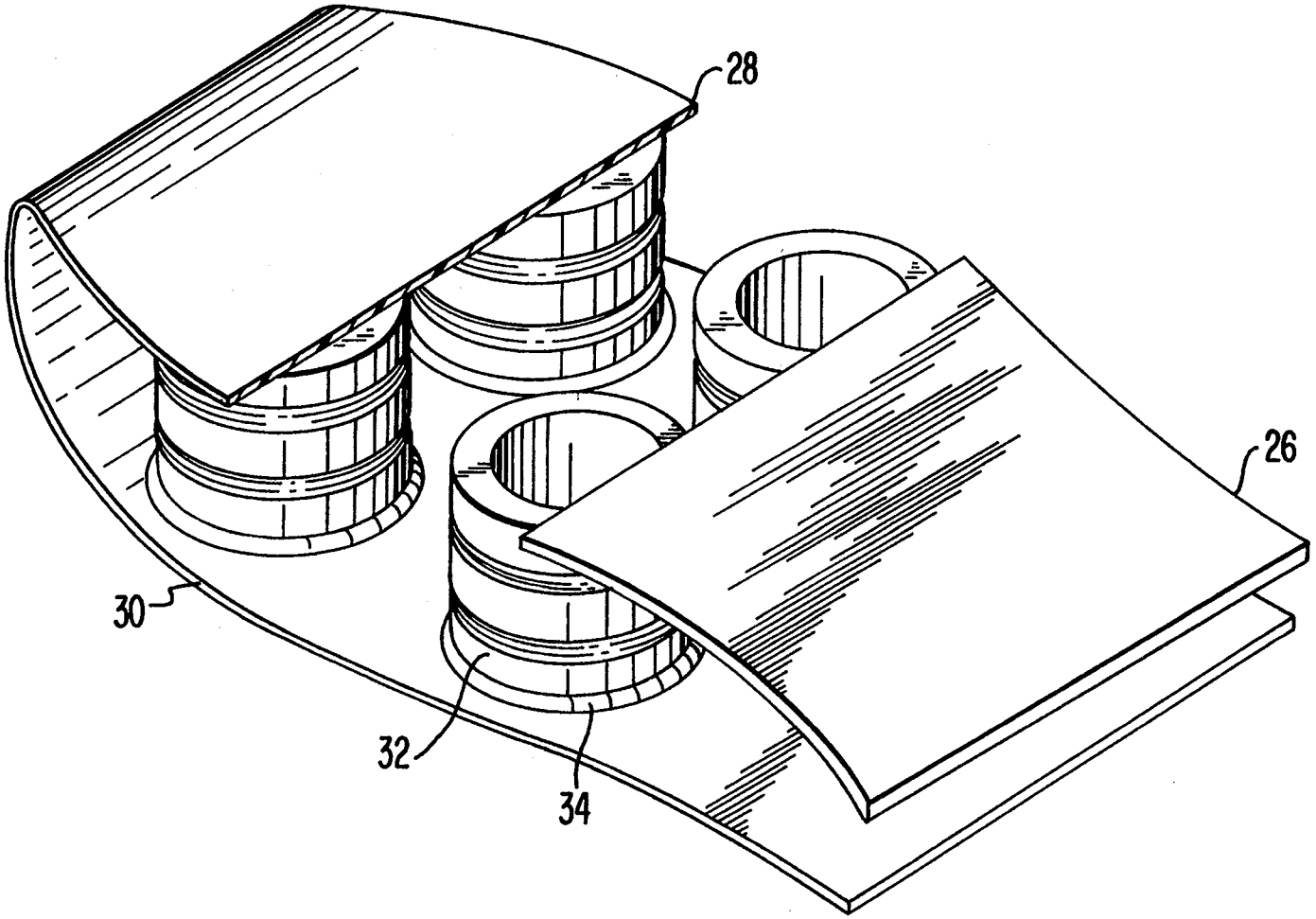

Alternatively, upper and lower plates 28 and 30 need not be joined and could take the form of unconnected upper and lower plates, or could be joined in only one portion, for example, the front or back, as shown in FIGS. 2*b* and 2*c*. This embodiment has the advantage of reducing shoe weight and the complexity of the manufacturing operation. As a further alternative, shell 26 could have the shape shown in FIGS. 4*a*–4*d*, in which shell 26' includes diagonal crossing member 33 extending between upper and lower plates 28' and 30'. This embodiment has the advantage of increasing torsional and lateral rigidity of the midsole and reducing the size of and thus the weight associated with support elements 32 and is particularly useful in creating a midsole with particularly low energy losses and low weight.

Figure 5A:
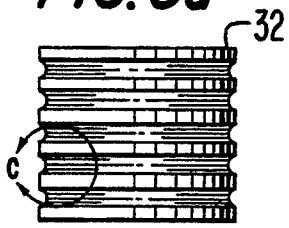
FIG. 5*a* is a side view of a support element according to the present invention having a hollow cylindrical shape.
Figure 5B:
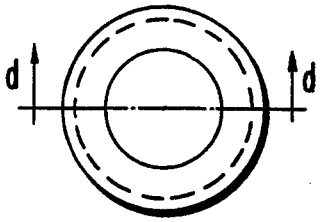
FIG. 5*b* is an overhead view of the element shown in FIG. 5*a*.
Figure 5C:
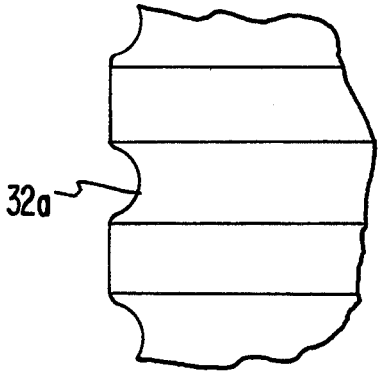
FIG. 5*c* is a closeup view of Circle "c" shown in FIG. 5*a*.
Figure 5D:
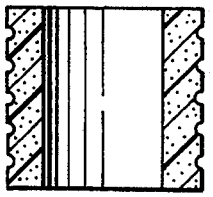
FIG. 5*d* is view along line d—d shown in FIG. 5*b*.

With reference to FIGS. 5*a*–5*c*, a first embodiment of support elements 32 are shown. Support elements 32 may have an overall hollow cylindrical shape and may have smooth exterior surfaces. Alternatively, the outer surface may be escalloped, that is, support elements may include spaced grooves 32*a* formed in the exterior surface. Support elements 32 may be made from the elastomeric foam materials discussed above such as microcellular ELASTOCELL TM or other microcellular elastomeric materials having the same properties.

Figure 3D:
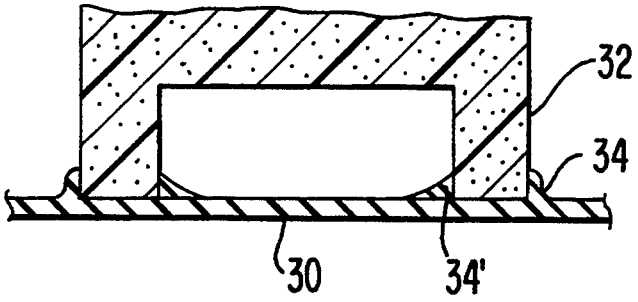
FIG. 3*d* is a close-up view similar to the view in FIG. 3*c* showing a second embodiment of the support element and detents.
Figure 4A:
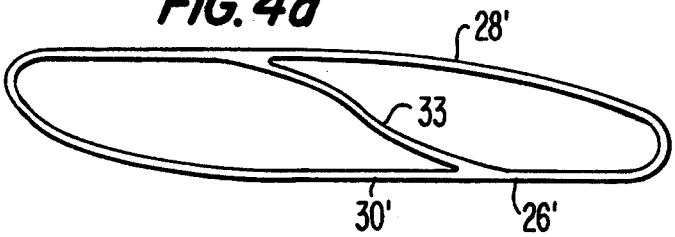
FIGS. 4*a*–4*d* show a further embodiment of a shell for a cushioning component according to the invention.
Figure 4B:
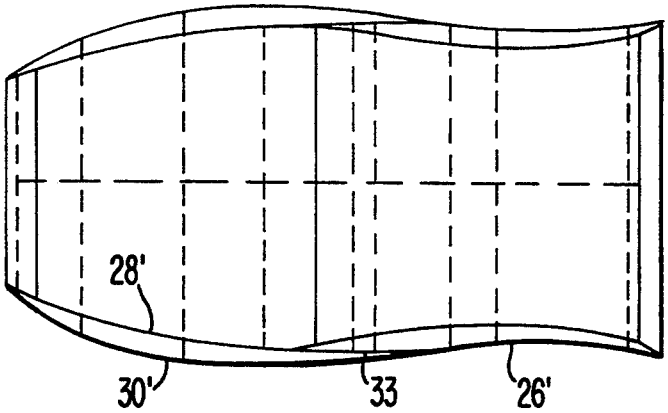
Figure 4C:
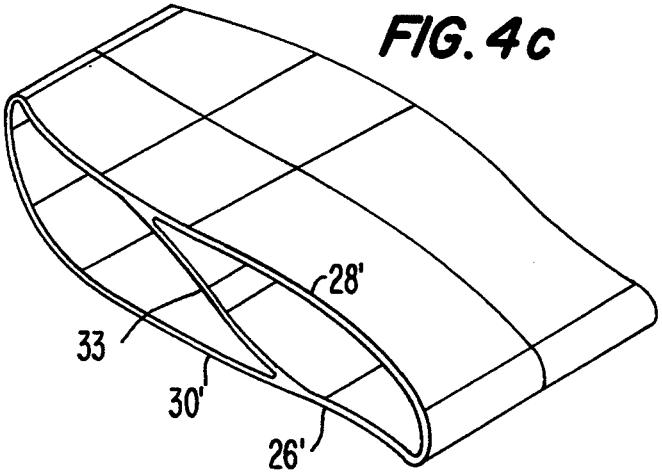
Figure 4D:
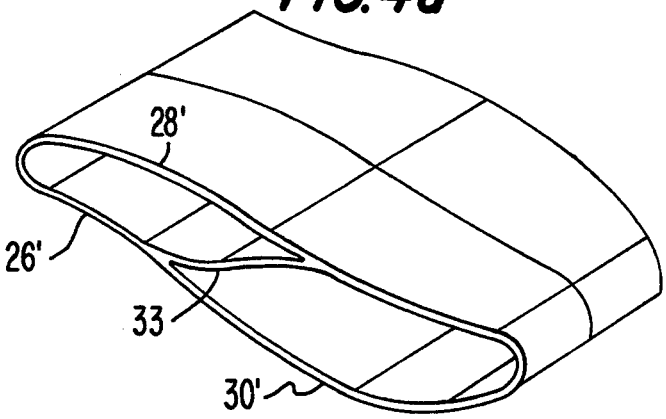

As shown in FIGS. 2*a*–2*c*, four support elements 32 may be disposed between the upper and lower plates. Elements 32 are generally disposed in a rectangular configuration, with a pair of anterior lateral and medial elements and a pair of posterior lateral and medial elements. Elements 32 are secured to the upper and lower plates by a suitable adhesive such as a solvent based urethane adhesive. Elements 32 are positioned within raised circular detents 34, which are disposed on upper and lower plates 28 and 30 and abut the outer cylindrical surface of elements 32. As shown in FIG. 3*d*, inner detents 34' also may be provided to abut the inner surface of the elements. The provision of four detents for four support elements is shown as an example only, and more or less support elements could be used within the scope of the invention.

Figure 1B:
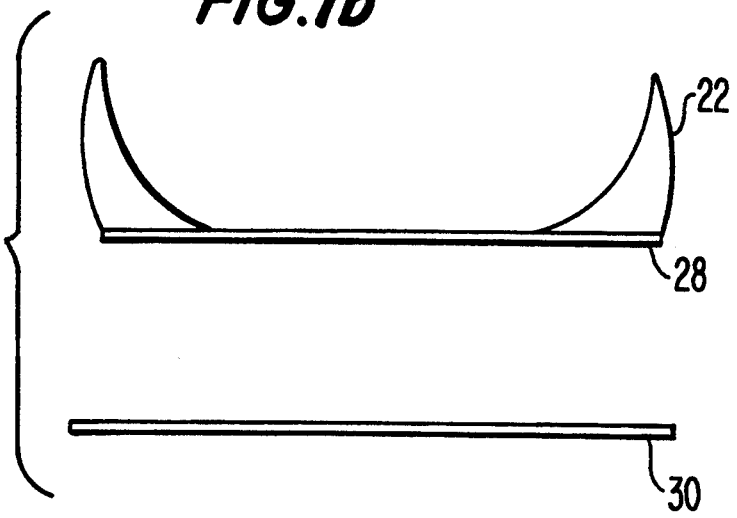
FIG. 1*b* is a cross-sectional view along line b—b shown in FIG. 1*a*.
Figure 1A:
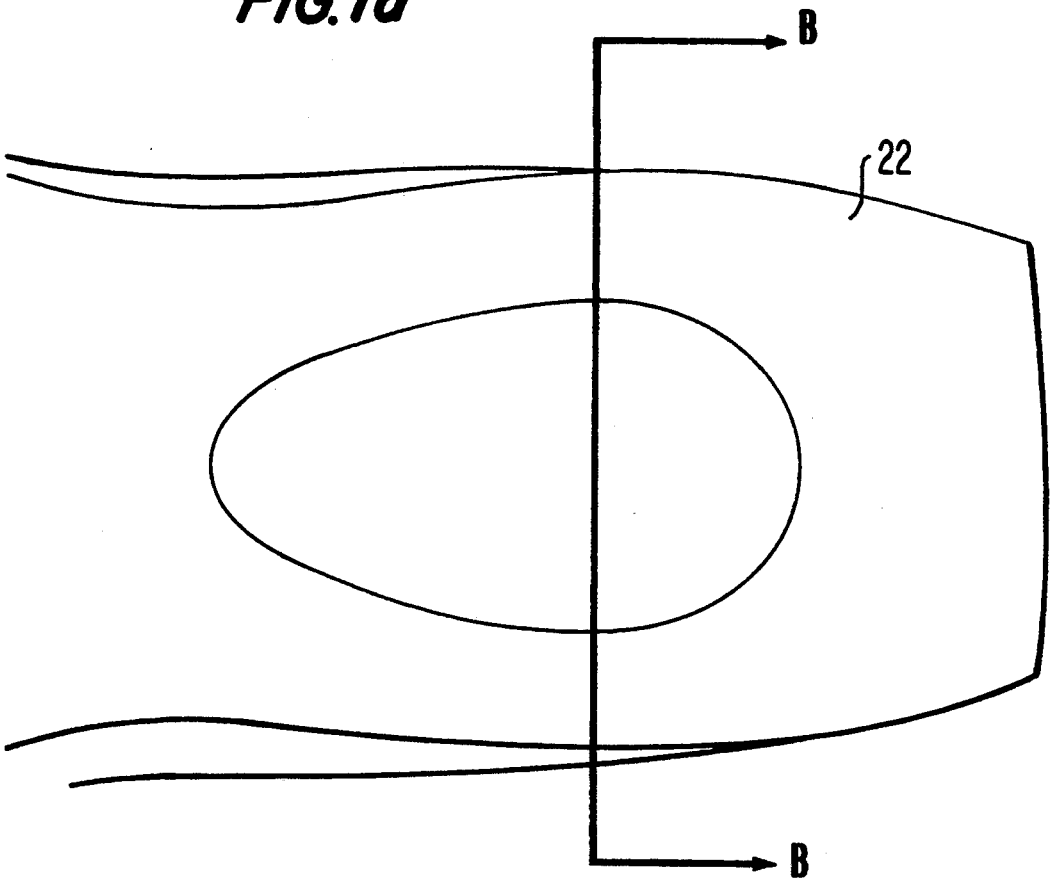
FIG. 1*a* is a cross-sectional view along line a—a shown in FIG. 1.

Preferred embodiments for the exact positioning of elements 32 are disclosed below in Table A. As shown, two detents 34 may be disposed on either side of the sagittal plane. In order to maximize the cushioning, it is desirable that no support element be disposed directly beneath the calcaneus, and as shown in FIG. 3*a*, detents 34 may be located such that the midpoint of elements 32 generally corresponds with the center of the plantar surface of the calcaneus, which is the location of the greatest vertical load, and which is shown as reference numeral 33 in FIG. 3*a*. As measured along an anterior-posterior axis, the center point is located at approximately 15% of the length of the foot as measured from the posterior-most aspect of the heel parallel to a line tangent to the medial-most edges of the heel and forefoot, as shown in FIG. 18*b*. In addition, as shown in FIGS. 1*a* and 1*b*, cushioning layer 22 is also not disposed directly beneath the calcaneus, substantially throughout the region located above the space between elements 32 and may be eliminated entirely throughout most or all of the region above shell 26.

With reference to Table A, each of the four embodiments of envelope disclosed therein is used in one of the four ranges of men's shoe sizes shown in the table, and the three ranges of women's shoe sizes which correspond to the first three men's size ranges. The measurements are in millimeters and are defined as follows: WIDTH is the width of the envelope at the rear; LENGTH is the overall length of the envelope; HEIGHT is the height of the envelope measured from the lowermost surface of the lower plate to the uppermost surface of the upper plate; DIST. TO CALCANEUS is the distance along the anterior-posterior axis from the rear of the envelope to the center of the calcaneus for the particular foot size shown; AXIAL DIS. REAR COLS. is the distance along the anterior-posterior axis from the rear of the envelope to the center of the rear columns; AXIAL DIST. FOR. COLS. is the distance along the anterior-posterior axis from the rear of the envelope to the center of the forward columns; SAG. PLANE REAR COLS. is the perpendicular distance from the sagittal plane to the center of the rear columns; and SAG. PLANE FOR. COLS. is the perpendicular distance from the sagittal plane to the center of the forward columns.

TABLE A

| SIZE RANGE | M4–M6 W5½–W7½ | M6½–M8½ W8–W10 | M9–M11 W10½–W12½ | M11½–M15½ |
|---|---|---|---|---|
| WIDTH | 40.8 | 42.5 | 44.4 | 47.4 |
| LENGTH | 137.5 | 147.1 | 156.5 | 168.8 |
| HEIGHT | 27.4 | 27.7 | 27.7 | 27.7 |
| DIST. TO CALCANEUS | 57.4 (Mens 5) | 60.5 (Mens 7) | 65.2 (Mens 9) | 70.8 (Mens 12) |
| AXIAL DIS. REAR COLS. | 35.7 | 38.9 | 40.4 | 40.5 |
| AXIAL DIST. FOR. COLS. | 73.1 | 79.6 | 87.5 | 94.5 |
| SAG. PLANE REAR COLS. | 17.7 | 18.1 | 19.7 | 22.0 |
| SAG. PLANE FOR. COLS. | 18.8 | 19.6 | 20.3 | 22.6 |

For the men's 4–6/women's 5½–7½ embodiment of shell 26, detents 34 measure 26.4 mm in inner diameter, 28.3 mm in diameter at the outer surface of the uppermost extension of detent 34, and 30.3 mm in diameter as measured at the base of detent 34. The corresponding measurements for the remaining embodiments are 29.6 mm. 31.5 mm and 33.5 mm.

As discussed above, during a footstrike, the initial contact is made at the rearfoot lateral location, with the foot rolling anteriorly and medially. Thus, the initial load is supported primarily by the rear lateral element 32, with the load progressively transferred anteriorly and medially to the other elements, as the foot pronates. Since each of support elements 32 is fixed to upper plate 28, the plate serves to distribute the load among the support elements. Lower plate 30 also distributes the impact. Accordingly, during initial impact at footstrike, when the load is minimal, the foot is supported almost entirely by the stiffness of the rear lateral column. This stiffness will be sufficient to provide adequate cushioning throughout the initial period of the footstrike. Since at the time of initial impact, the other support elements 32 are not significantly compressed, the overall stiffness of midsole 18 is substantially equal to the stiffness of the rear, lateral column. Thus, the feel of midsole 18 will not be stiffer than desired during the initial footstrike.

After the initial impact, the other support elements 32 will be compressed to a greater degree, due to the anterior and medial movement of the load as well as the distribution of the force provided by upper plate 28 and lower plate 30. Thus, the other elements will contribute to the overall stiffness of midsole 18 to an increasing degree as they are compressed. Therefore, when maximum load is achieved, the overall stiffness of midsole 18 will be sufficient to provide adequate cushioning, without requiring excessive stiffness at the initiation of footstrike. Since the load is gradually distributed from the lateral rear column to the other support elements 32, the increase in stiffness corresponds to the increase in load, such that the wearer does not experience bottoming-out. In addition, no support element is provided directly beneath the center of the calcaneus, ensuring that the maximum load will be distributed away from the calcaneus and to each of the support elements. This arrangement also increases attenuation of impact load, in a manner consistent with the disclosure of U.S. Pat. No. 4,439,936 to Clarke et al, hereby incorporated by reference.

Figure 6A:
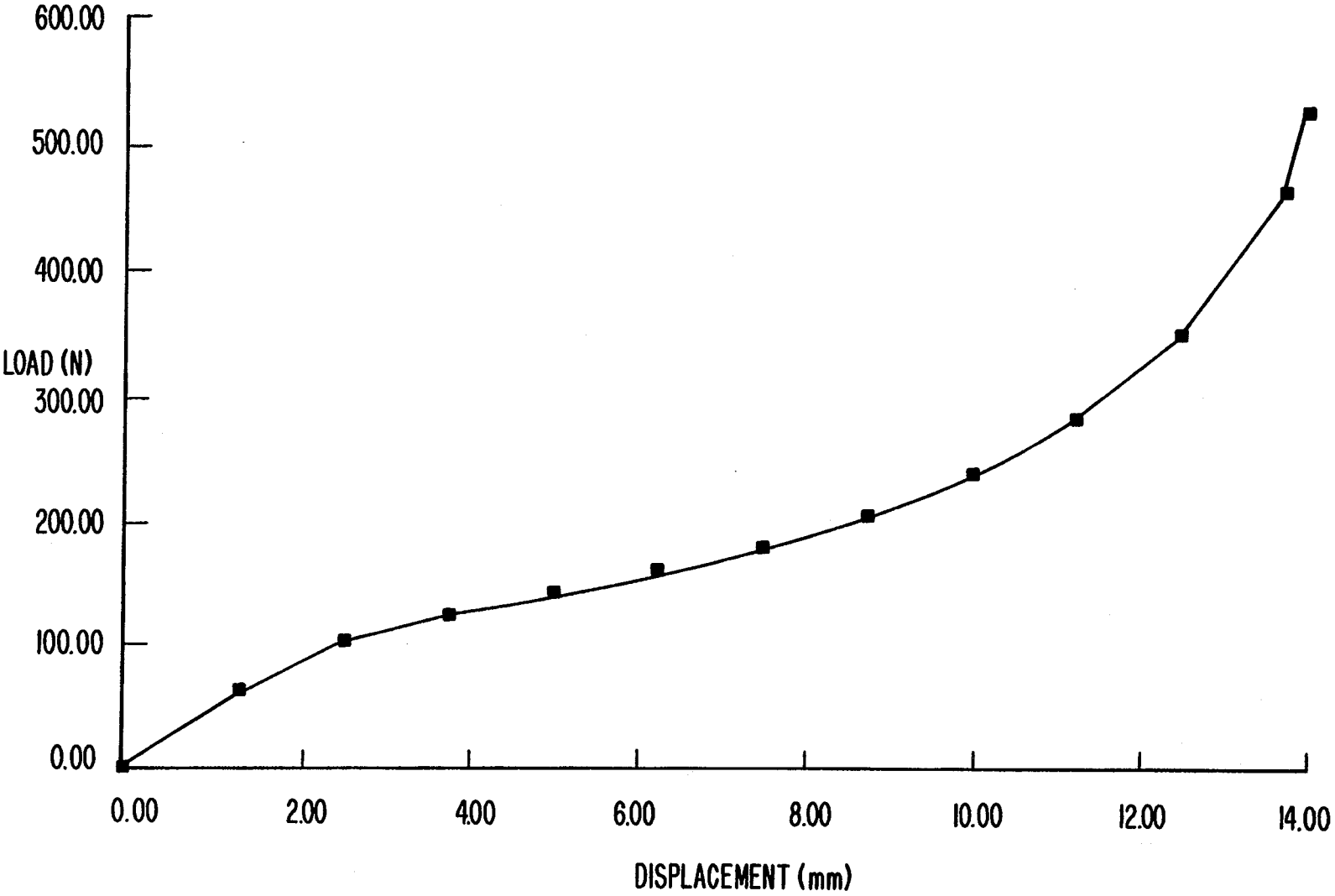
FIG. 6*a* is a graph of the load applied to a hollow support element as shown in FIG. 5 as a function of the displacement of the column.

The use of microcellular as opposed to non-microcellular polyurethane foam for the columns allows for the gradual increase in stiffness to be obtained without having the stiffness be too great or small at the location of the initial impact. It has been experimentally determined that for the average runner, a stiffness on the order of 70–100 N/mm is desired at the time of maximum loading. At the time of initial impact, a stiffness on the order of 20 N/mm is desired. FIG. 6*a* is a graph of the load applied to a hollow support element as shown in FIG. 5 as a function of the displacement of the column, that is, the vertical compression. The column is made of microcellular NDI and has a height of 25.4 mm and a density of 0.423 g/cm$^3$. As the column is subjected to increasing load, it continues to compress to support the load, to a greater degree than with prior art materials. In addition, the column does not undergo a sudden increase in stiffness such as would cause the column to bottom-out.

Figure 6B:
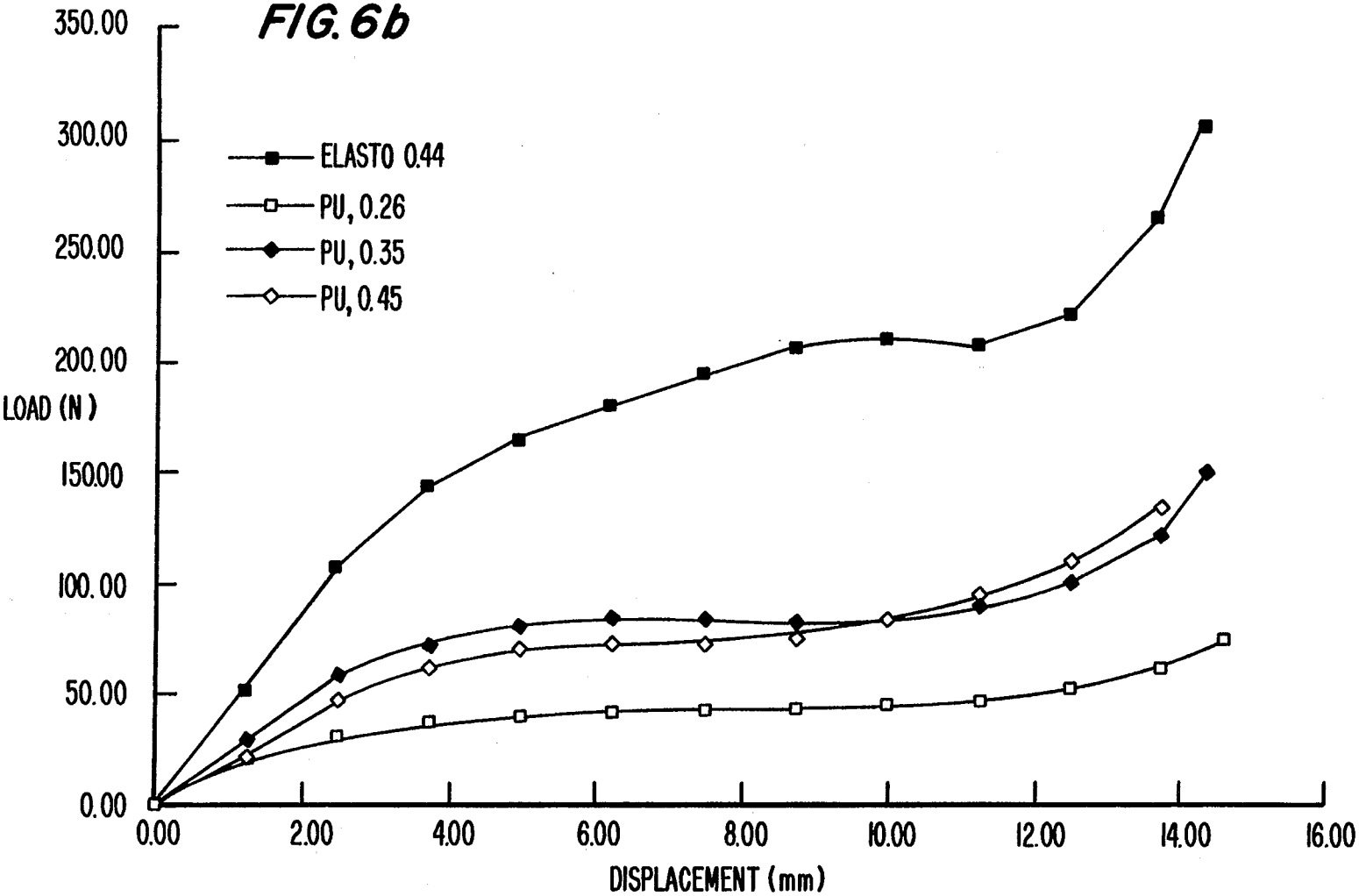
FIG. 6*b* shows graphs of loads as a function of displacement for foam columns according to the present invention and the prior art.

With further reference to FIG. 6*b*, the advantage provided by the use of microcellular columns as opposed to non-microcellular columns will be explained. In FIG. 6*b*, the graphs of loads as a function of displacement are shown for a column made of microcellular NDI ("Elasto") and having a density of 0.44 g/cm$^3$, as well as columns made of non-microcellular MDI (PU) and having densities of 0.26, 0.35 and 0.45 g/cm$^3$. The columns each have a height of 25.4 mm, an outside diameter of 29.2 mm and an inside diameter of 18.5 mm. As can be seen, the MDI columns cease to undergo additional compression with increasing loads at loads which are much lower than the loads at which the NDI columns cease to undergo additional compression. For example, all of the non-microcellular tested materials cease to undergo additional compression at approximately 80N, at a displacement of under 6 mm. However, a column made of microcellular NDI having nearly the same density does not cease to undergo additional compression until a load of over 200N is applied, at a corresponding displacement of 9–10 mm.

The loads applied to the midsole at the lateral rear location during initial impact can easily exceed a level which will cause the conventional polyurethane columns to cease undergoing additional compression before the load is transferred forwardly and medially to the other columns. Since the column made from microcellular NDI does not cease to undergo additional compression until a much greater load is applied, support is provided throughout the period of initial contact until the load is transferred to the remaining columns. That is, as the load at the lateral rear increases, the lateral rear column will continuously compress to support the load. By the time the load reaches a level at which the column will not undergo additional compression with increasing load, the load will be distributed to the other columns. Thus, the use of microcellular NDI simultaneously achieves the goals of low initial stiffness at the lateral rear to correspond to lower initial loads, increasing stiffness to correspond to increasing loads, and avoidance of bottoming-out during the ground support phase.

These goals cannot be achieved simultaneously with the non-microcellular polyurethane, even if the four column design were used. If the columns had the densities shown in FIG. 6*b*, the wearer would experience bottoming out, at least at the lateral rear location, since the load at which the material would cease to undergo additional compression is under 80N. Thus, distribution of the load will not occur before the load exceeds the support capability of the lateral rear column. Alternatively, in order to allow for continuous compression throughout a higher range of loads, the initial stiffness would have to be greatly reduced. Thus, the midsole would feel mushy, and the height of the columns would have to be greatly increased, resulting in instability.

Figure 6C:
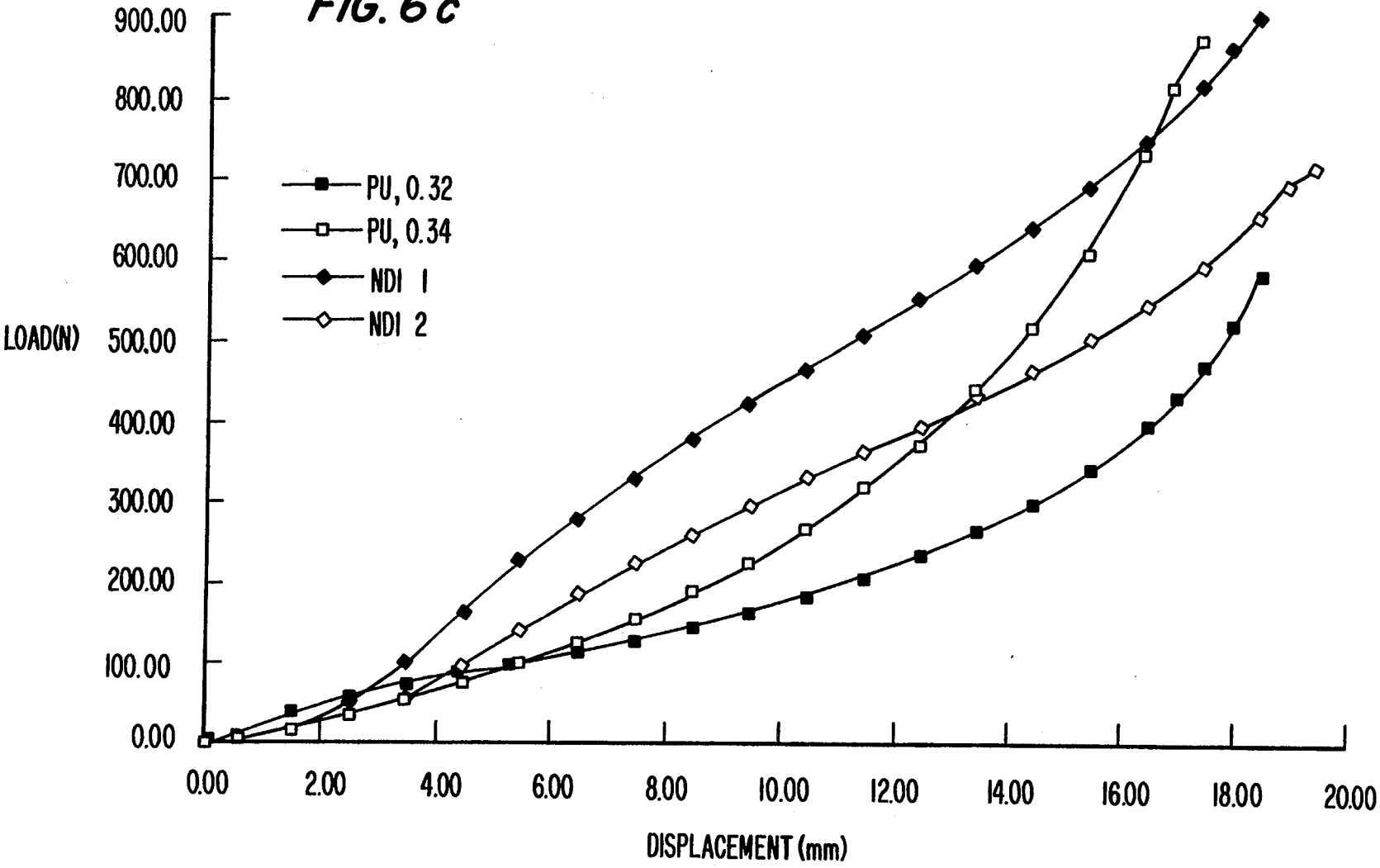
FIG. 6*c* shows graphs of load as a function of displacement for a midsole having the structure shown in FIG. 2*a* with support elements made of microcellular NDI and a solid midsole made of non-microcellular polyurethane.

FIG. 6*c* shows graphs of load as a function of displacement for two midsoles having the structure shown in FIG. 2*a* with support elements made of microcellular NDI and two midsoles made of solid non-microcellular polyurethane. As can be seen, the curves for the present invention are more linear than the curves of the prior art, that is, the midsoles according to the present invention continue to undergo compression at increased loads throughout a greater range than in the prior art. Thus, the stiffness continually increases to support the increasing load, and bottoming-out can be avoided throughout substantially the entire range of compression of the midsole.

Furthermore, the durability of the microcellular foam is superior to non-microcellular polyurethane foams which have previously been used for cushioning. For example, after repeated compression, elastomeric foams will undergo some degree of permanent setting, that is, the foam element will remain compressed to a certain degree even when the load is removed. The compression of a microcellular foam element as a percentage of height is much lower than non-microcellular foams. In addition, after repeated compression, the vertical displacement of the foam element as a function of force, that is, the stiffness of the foam element, will be decreased such that for a given applied load the displacement of the element is increased after repeated use. In other words, the element will undergo greater compression for a given load. Thus, after repeated use, a foam midsole will not be able to support as great a load before reaching maximum compression, such that it is more likely to undergo bottoming-out. Once again, this change in stiffness is much greater for non-microcellular polyurethane foams used in the prior art than it is for microcellular foams.

Figure 6D:
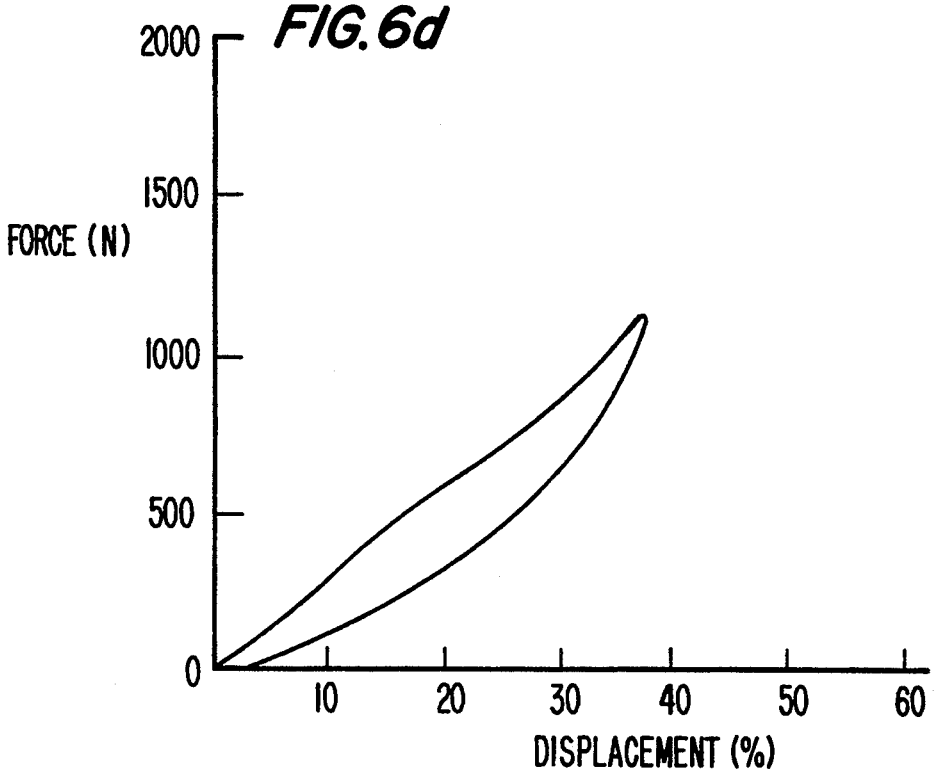
FIG. 6*d* is a graph showing the force as a function of the displacement percentage of the overall length for a microcellular NDI column.
Figure 6E:
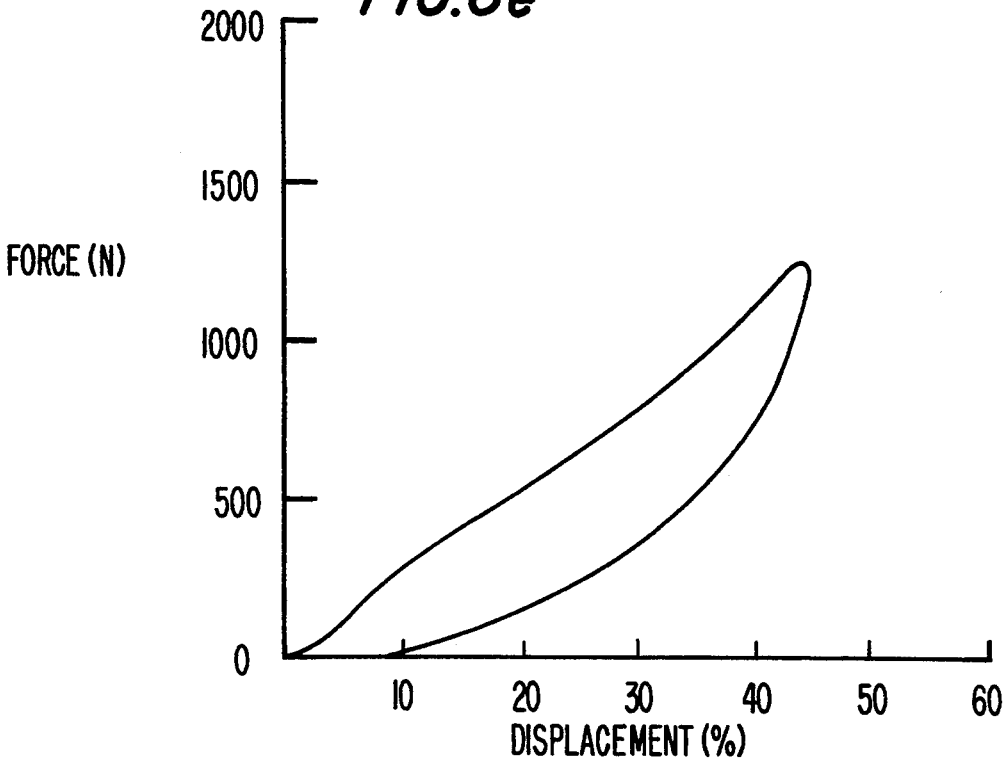
FIG. 6*e* is a graph showing the force as a function of the displacement percentage of the overall length for a non-microcellular MDI column.

A further advantage provided by the use of microcellular polyurethane as opposed to non-microcellular polyurethane is evident from the graphs of FIGS. 6*d* and 6*e*, which shows the force as a function of the displacement percentage of the overall length for a microcellular NDI column and a non-microcellular MDI column, respectively. The upper part of each graph represents the compression by an applied load and the lower part represents the decompression as the load is removed. In each case, the percentage of compression for a given load is higher as the load is removed, indicating a loss of energy during the impact. However, the energy loss is much greater for the non-microcellular MDI than it is for the microcellular NDI. In particular, the non-microcellular MDI has a 56% energy loss as compared to a 37% energy loss for the microcellular NDI.

Accordingly, it can be seen that a midsole according to the present invention which includes a plurality of hollow elements constructed from a microcellular foam material such as ELASTOCELL® NDI improves over the prior art non-microcellular polyurethane foams by providing a lower stiffness at the location of the initial impact which corresponds to lower initial loads, and a smooth transition to a much higher stiffness corresponding to the maximum load which is achieved beneath the calcaneous, with the higher load distributed throughout the rear of the midsole. In addition, the desired stillnesses are achieved in a manner which avoids bottoming-out throughout the ground support phase, without increasing the weight and initial stiffness of the midsole beyond a desired level.

It has been experimentally determined that in general, the best rearfoot control characteristics are obtained with elastomeric support elements of the preferred embodiment having a density ranging from 0.25–0.65 g/cm$^3$, and in particular, a density of 0.41 g/cm$^3$, and a height range of 15–35 mm, with a consistent height and density used for all of the support elements. Of course, in practice, one or more of the support elements could have a different height and/or density. Table B discloses linear sizes and density ranges of preferred embodiments of support elements 32. The linear measurements are given in millimeters, the weight ranges are given in grams and the densities are given in grams/cm$^3$. The inside diameter is the diameter of the circular opening. The first measurement for the outside diameter represents the diameter as measured at the base of a groove 32*a*, as shown in FIG. 5*c*, and the second measurement represents the diameter as measured at the outermost surface of the column. Preferably, support element embodiment C is used for the men's 4–6/women's 5½–7½ embodiment of the shell as shown in Table A. Support element embodiment A is used for all other embodiments of the shell. In addition, embodiment A preferrably is used in men's running shoes. Embodiment B preferrably is used in men's cross-training shoes. Embodiment C preferrably is used in women's running shoes. Embodiment D preferrably is used in women's cross-training shoes

TABLE B

| EMBODIMENT | HEIGHT | INSIDE DIAMETER | OUTSIDE DIAMETER | DENSITY RANGE |
|---|---|---|---|---|
| A | 25.4 | 14.7 | 27.2–29.2 | 0.407–0.441 |
| B | 20.1 | 14.7 | 27.2<br>29.2 | 0.407–0.441 |
| C | 25.4 | 10.5 | 24.0<br>26.0 | 0.334–0.373 |
| D | 20.1 | 10.5 | 24.0<br>26.0 | 0.334–0.373 |

As discussed above, the outer surface of support elements 32 may be escalloped and include a plurality of spaced grooves 32*a*. In general, the overall force deflection curve of the support elements can be altered by geometry changes, that is, alteration of the outer or inner diameter when the support elements are in the form of hollow columns, or the use of escalloped surfaces, or by changing the density. The use of an escalloped outer surface provides the advantage that large vertical compressions are facilitated by the pre-wrinkled shape, that is, the columns tend to be deflected more vertically. If the columns are designed with straight walls rather than escalloped walls, the tendency of the column to buckle is greater. Buckling of the columns is associated with a sudden change in the force-deflection curve. Thus, the shapes and sizes of the grooves can be selected to construct a column having a more linear compression as a function of applied force than columns having straight surfaces.

Since the stiffness is determined substantially by the density, dimensions and surface contours of the support elements as well as their location in the envelope, these factors can be adjusted to preclude any abrupt changes in stiffness and bottoming-out for typical loads and the likely maximum applied force. In addition, by selecting the relative locations of the support elements, the cushioning for each shoe size can be approximately tuned to a desired level of stiffness for a selected range of forces, while providing maximum rearfoot control. The exact determinations would be made by determining the level of force which would be applied by wearers likely to have body weights in a range corresponding to a given shoe size, and taking into account the stability requirements of the activity for which the shoe is designed to be used. For example, most runners apply a maximum vertical force of about 2.4 times body weight during steady long-distance running, and this factor would be considered in designing a running shoe for a runner of normal weight. Such determinations can be made by one skilled in the art without undue experimentation.

Figure 7A:
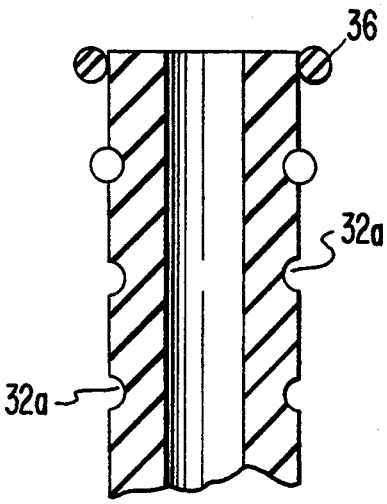
FIGS. 7*a*–7*b* are views showing a foam column having grooves in the exterior surface in conjunction with a ring removably disposable in the groove.
Figure 7B:
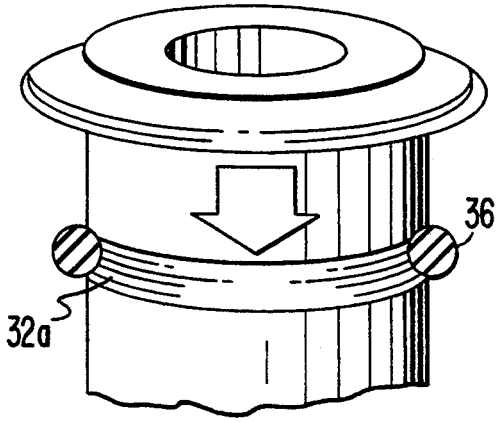

Furthermore, as shown in FIG. 7, the compliance of the columns and the overall stiffness of the midsole can be made adjustable by the provision of elastomeric rings 36 in grooves 32*a*. Rings 36 can be slid to fill the grooves to adjust the compliance as desired. Generally, as the grooves are filled with the ring, the compliance of each individual support element is stiffened. In this manner, the wearer can individually tune the stiffness of the midsole to his own requirements, taking into account body weight and the activity for which the shoe will be used. Rings 36 may be made from rubber or urethane elastomer.

Figure 8:
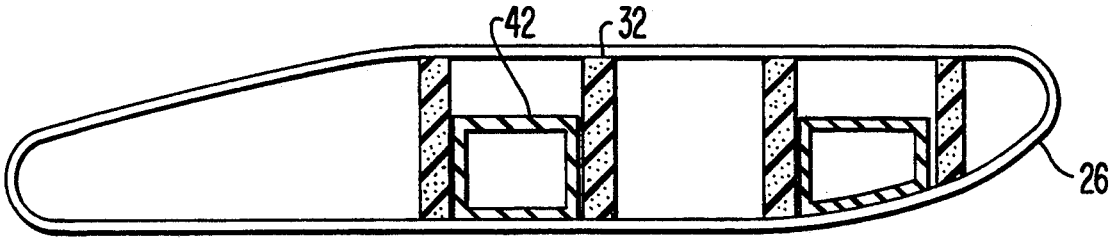
FIG. 8 is a side view of a cushioning and stability component in which the support elements include both inner and outer support elements.

With reference to FIG. 8, a further embodiment is shown in which internal element 42 is disposed within the hollow area of support element 32, which as shown in this example have the form of hollow columns. Element 42 may comprise a cylindrical bladder filled with a gas and in one embodiment may be loosely fitted into the hollow circular area of support elements 32, that is, bladders 42 are distinct from and are not attached to support elements 32. Bladders 42 may be filled with air. In a preferred embodiment in which the column dimensions are as shown in TABLE B, bladders 42 have a height of 15 mm, and an outside diameter of 10.5 mm for the the men's 4–6 embodiment and 14.7 mm for the other embodiments. Alternatively, bladders 42 may be made of the types of materials and filled with the types of gases disclosed in U.S. Pat. No. 4,183,156 to Rudy, hereby incorporated by reference. As disclosed in this patent, a preferred material for the bladders is a cast or extruded ether base polyurethane film having a shore "A" durometer hardness in the range of 80–95, e.g., TETRA-PLASTICS TPW-250. Preferred gases for use in the bladders are hexafluorethane (e.g., Freon F-116) and sulfur hexafluoride.

Since bladders 42 are not connected to support elements 32 and have a height less than that of support elements 32, they will not affect the stiffness during the application of normal loads due to the fact that elements 32 will not be compressed to the level of bladders 42. However, bladders 42 compensate for loads which deviate from the norm and thus ensure the provision of adequate cushioning for various activities. For example, a shoe may be designed for both walking and running, and the normal expected load on the midsole would be the load experienced during walking. As discussed above, support elements 32 would be designed to provide a desired level of cushioning and stability control for the light loads experienced during walking, and during walking, elements 32 would not be compressed to a level where the height of the elements was less than the height of bladders 42. Therefore, bladders 42 would not be compressed and would have no effect on cushioning.

When the shoe is worn during running, greater loads would be experienced. These loads would cause compression of external elements 32 to a height less than the height of bladders 42. Thus, both bladders 42 and elements 32 would support the load, and the stiffness of bladders 42 would be added to the stiffness of elements 32 in order to provide the proper cushioning. By appropriately selecting the dimensions of the inner and outer elements, as well as the material of the inner element (air bladder or a post made of the same or a different cushioning material,) a single shoe can be designed to provide a desired level of cushioning for more than one activity.

The use of the internal post or bladder also compensates for people who may be heavier than normal for their shoe size. Heavier individuals may cause the loads developed on the midsole to exceed the expected load during normal activity. These loads may cause the compression of the outer element to exceed the threshold, and result in bottoming out. The use of both the inner and outer elements provides the desired cushioning and helps preclude bottoming-out in this situation by providing a greater stiffness during normal activity for heavier individuals since both the inner and outer elements will be engaged. Thus, the stiffness will not be too soft for heavier individuals during lighter activities. However, by providing both an inner and outer element which are not connected to each other, the stiffness will not be too large for normal sized individuals since during lighter activity the outer element will not be compressed to a height less than the inner element.

Figure 16:
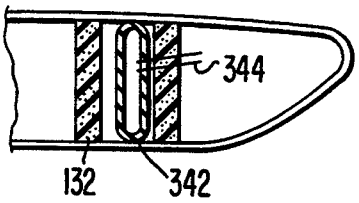
FIG. 16 is a side view similar to the view of FIG. 15 in which the second element is disposed in the interior of the hollow cylindrical element.

Accordingly, the provision of inner elements 42 provides adequate cushioning for individuals of normal weight for activities which provide a variety of loads on the midsole. In addition, elements 42 compensate for the greater loads provided by heavier individuals during even light activity. Essentially, the use of a second element such as an inner post allows for a greater degree of tuning than is possible with just one element, since one element can be designed to provide adequate cushioning for the typical loads associated with one particular activity, while the second element, acting in parallel with the first element, can be designed to cushion for the higher loads associated with a second activity. In addition, the range of tuning of the cushioning can be adjusted by the individual wearer to suit his individual needs in several ways. For example, where the second element is an air bladder, the stiffness of the bladder can be adjusted by changing the inflation pressure thereof through a fill inlet disposed through the elastomeric element, as shown in FIG. 16. Alternatively, the inflation of the air bladder can be adjusted concurrently with movement of the ring elements to achieve a desired stiffness. In addition, the height of the second element can be adjusted, for example, by disposing a screw element at the bottom of the second element and a corresponding receiving element on the bottom plate.

As shown, insert bladders 42 may extend for approximately 60% of the height of column 32. Other heights may be used as well, as a matter of design choice. Although insert elements 42 are disclosed as cylindrical gas-filled bladders, it is foreseeable that other materials such as conventional foam, gels, liquids or plastics could be used in combination. In addition, elements 42 could be made from the microcellular materials disclosed above having either the same or different density.

Figure 14:
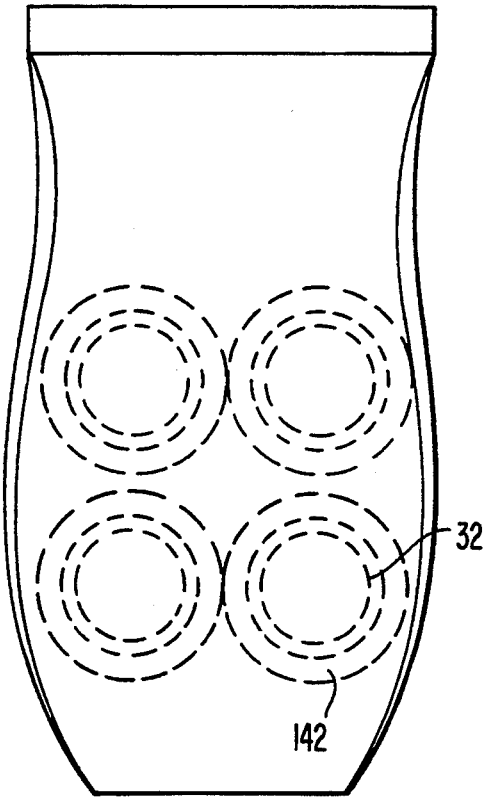
FIG. 14 is an overhead view showing a further embodiment of the cushioning and stability component including a plurality of hollow cylindrical elements each having a second support element disposed about the exterior thereof.
Figure 15:
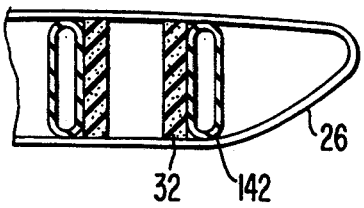
FIG. 15 is a side view of the combination of a single hollow cylindrical element and a second support element.

With reference to FIGS. 14–15, air bladder 142 may be formed in the shape of a hollow cylindrical column and disposed externally of foam column element 32, which is bonded to upper plate 28 and lower plate 30. Air bladder 142 is inflated to a pressure which causes its height to exceed the unloaded height of foam column element 32. Thus, foam column element 32 is in tension even when no external load is applied by a wearer, which causes foam column element 32 to be stretched beyond its relaxed height. Midsole 18 may be tuned to a particular stiffness by selecting the level of inflation of the bladder. Since both the air bladder and column will be compressed simultaneously throughout the ground support phase, each column/air bladder combination will have only one characteristic stiffness. However, this embodiment is particularly useful for tuning since each combination can be given a desired stiffness simply by adjusting air bladder pressure. Thus, the overall stiffness of the midsole can be adjusted for a given activity or wearer weight. In addition, each column/bladder combination easily can be given a different stiffness in accordance with the preference of the user.

As shown in FIG. 16, bladder 342 also can be disposed within the hollow region of column 32, with filler inlet 344 provided through the column element 32 for adjusting the inflation pressure. This embodiment provides puncture resistance for bladder 342 and ensures foam column element 32 will compress in an axially symmetric manner. Of course, filler inlet 344 could be disposed at other locations of bladder 342. For example, the filler inlet could be accessed from a superior or inferior position through an opening in the upper and lower plates of shell 26.

Figure 17A:
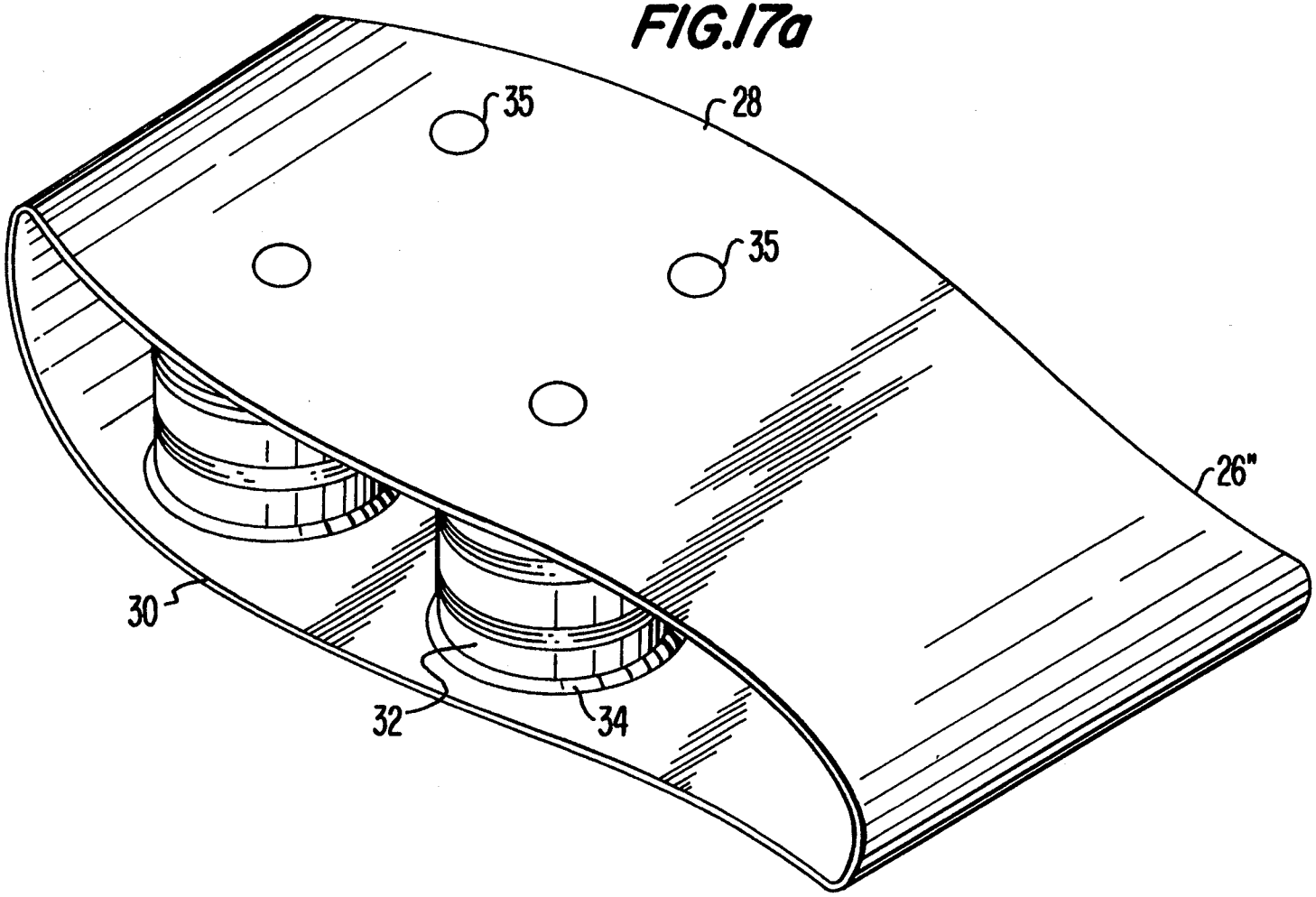
FIG. 17*a* is an overhead view of a cushioning and stability component according to a further embodiment of the invention.
Figure 17B:
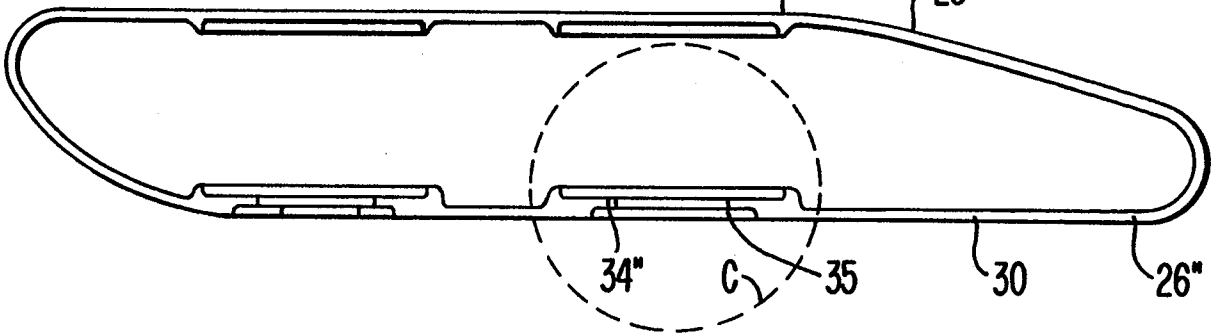
FIG. 17*b* is a side view of an embodiment of a cushioning and stability component similar to the embodiment shown in FIG. 17*a*.
Figure 17C:
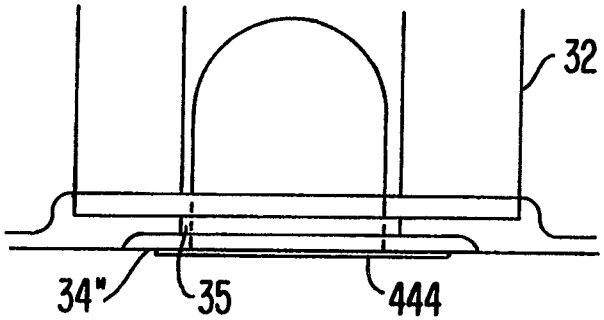
FIG. 17*c* is a close-up view of circle "C" shown in FIG. 17*b*.

With reference to FIG. 17*a*, a further embodiment of the cushioning component is shown. Cushioning component 26″ includes holes 35 formed through upper plate 28 at the locations of the centers of detents 34″. Holes 35 allow gas bladders 444 to be removably disposed therethrough. The shape of detents 34″ including holes 35 is shown more clearly in FIGS. 17*b* and 17*e*, in which holes 35 are formed through lower plate 30. In the embodiment shown in FIG. 17*a*, access to holes 35 for removal and replacement of bladders 444 is gained by lifting the sock liner which is disposed above conventional cushioning layer 22. Corresponding holes would also be formed through layer 22 if necessary. In the embodiment shown in FIGS. 17*b* and 17*c*, holes 35 are formed through lower plate 30, and coresponding holes would be formed through outsole layer 20. In both cases, the stiffness of the midsole easily can be tuned by the wearer simply by removing the bladder and replacing with another bladder, for example, an air bladder inflated to a different pressure and/or having a different height. Alternatively, a second foam element can be inserted in the hollow region of support element 32, or the hollow region can be left unfilled.

Figure 9B:
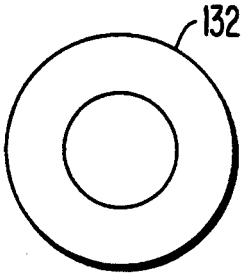

With respect to FIGS. 9*a*–9*f*, alternative configurations for support elements 32 are shown. FIGS. 9*a* and 9*b* disclose support element 132 having the shape of a column having cavity 134 extending inwardly from each planar surface and terminating at partition 136, thereby forming an element having an "H-shaped" cross-section. Cavities 134 have a circular shaped cross-section, with the radius of the cross-section slightly decreasing in the direction towards partition 136. This design reduces the length of the column which is hollow, and prevents buckling, thus allowing a deflection-force curve with a more substantially linear region and like working range than is the case for the simple hollow cylinder shown in FIG. 2*a*. If desired, inner elements 42 could be inserted in cavities 134.

Figure 9C:
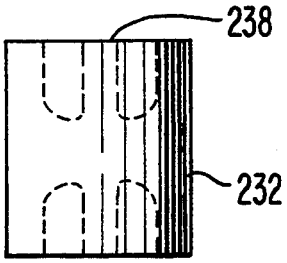
Figure 9D:
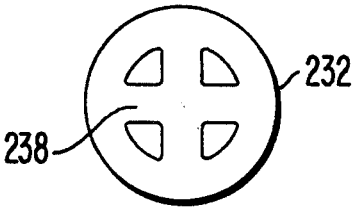
Figure 9E:
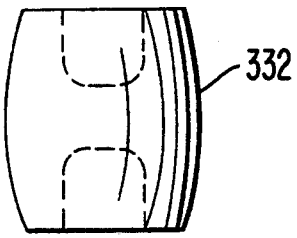
Figure 9F:
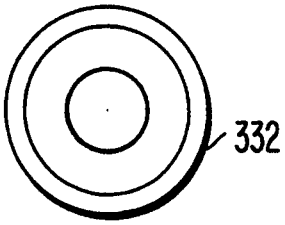

As shown in FIGS. 9*c* and 9*d*, support element 232 is similar to column element 132 having cavities 134, and further includes integrally formed foam webs 238 disposed in cavities 234 and extending from partition 136. Foam webs 238 have an "x-shaped" cross-section, and further reduce the buckling tendency of support elements 132 under large vertical compressions. With reference to FIGS. 9*e* and 9*f*, support element 332 is similar to support element 132, but is molded to have a barrel-shaped exterior surface. Once again, the shape of element 332 serves to preserve the linearity of the deflection-force curve by an axisymmetric deformation pattern at high loads.

Figure 12:
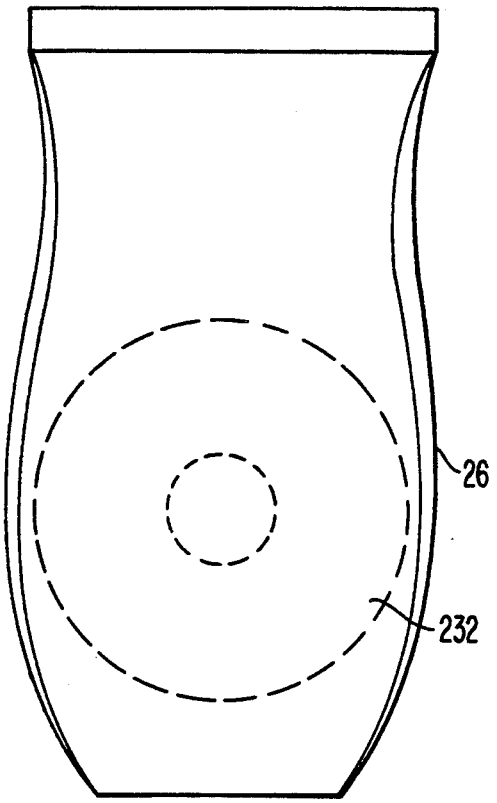
FIG. 12 is an overhead view showing a further embodiment of the cushioning and stability component including a single doughnut-shaped support element.
Figure 13:
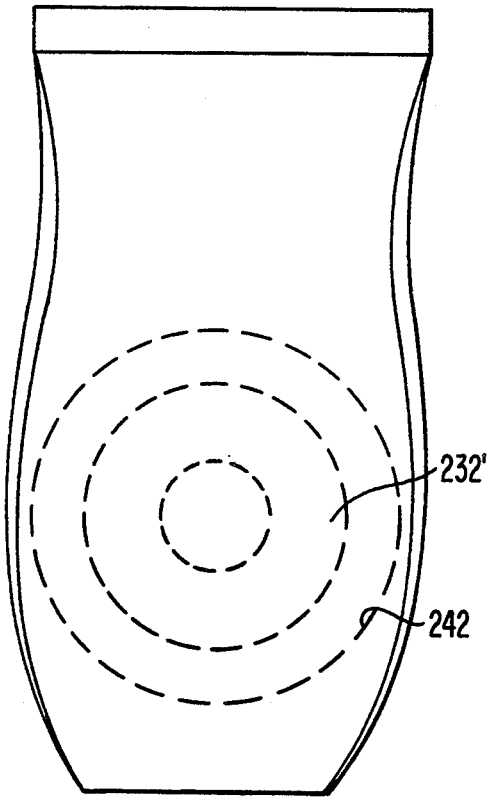
FIG. 13 is an overhead view showing a further embodiment of the cushioning and stability component including both a single doughnut-shaped support element and an outer element.

A further alternative embodiment for the support element is shown in FIG. 12. Support element 232 is essentially doughnut-shaped, and extends substantially throughout the rearfoot area of the midsole. The central hole of the doughnut is disposed beneath the center of the calcaneus. The initial load is supported on the lateral rear portion of element 232, and then moves anteriorly and medially during the breaking portion of the ground support phase. Thus, the stiffness of the midsole would increase to compensate for the increasing load, as described above with respect to the four column embodiment. With reference to FIG. 13, the use of support element 232′ with air bladder 242 is shown. Air bladder 242 is shown as surrounding support element 232′, but could also be disposed within the central hole. In either case, air bladder 242 could be inflated to a height which would cause element 232 to be stretched even when no load is applied by a wearer.

Figure 10A:
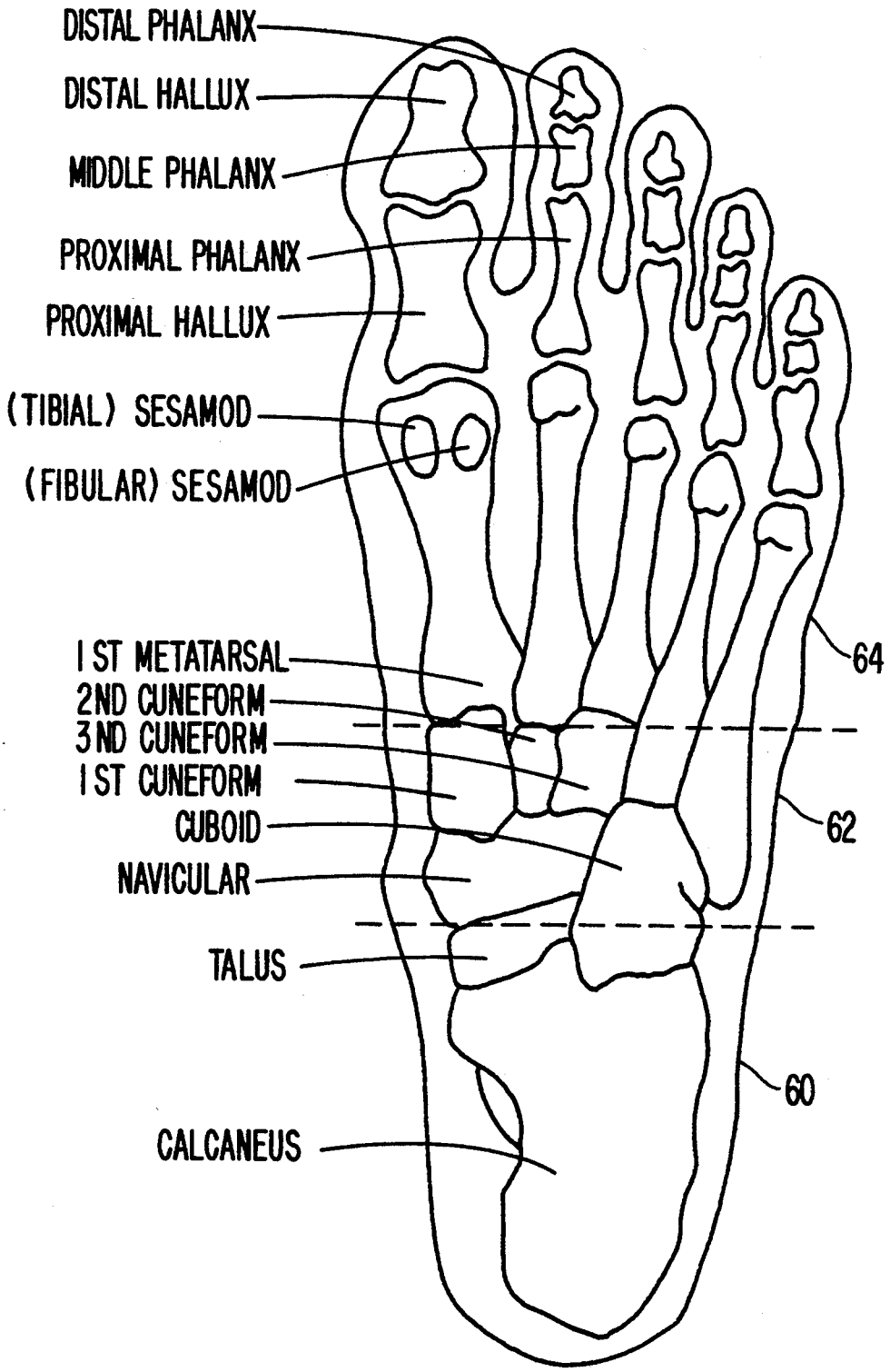
FIG. 10*a* is a plantar view showing the bones of the foot.
Figure 10B:
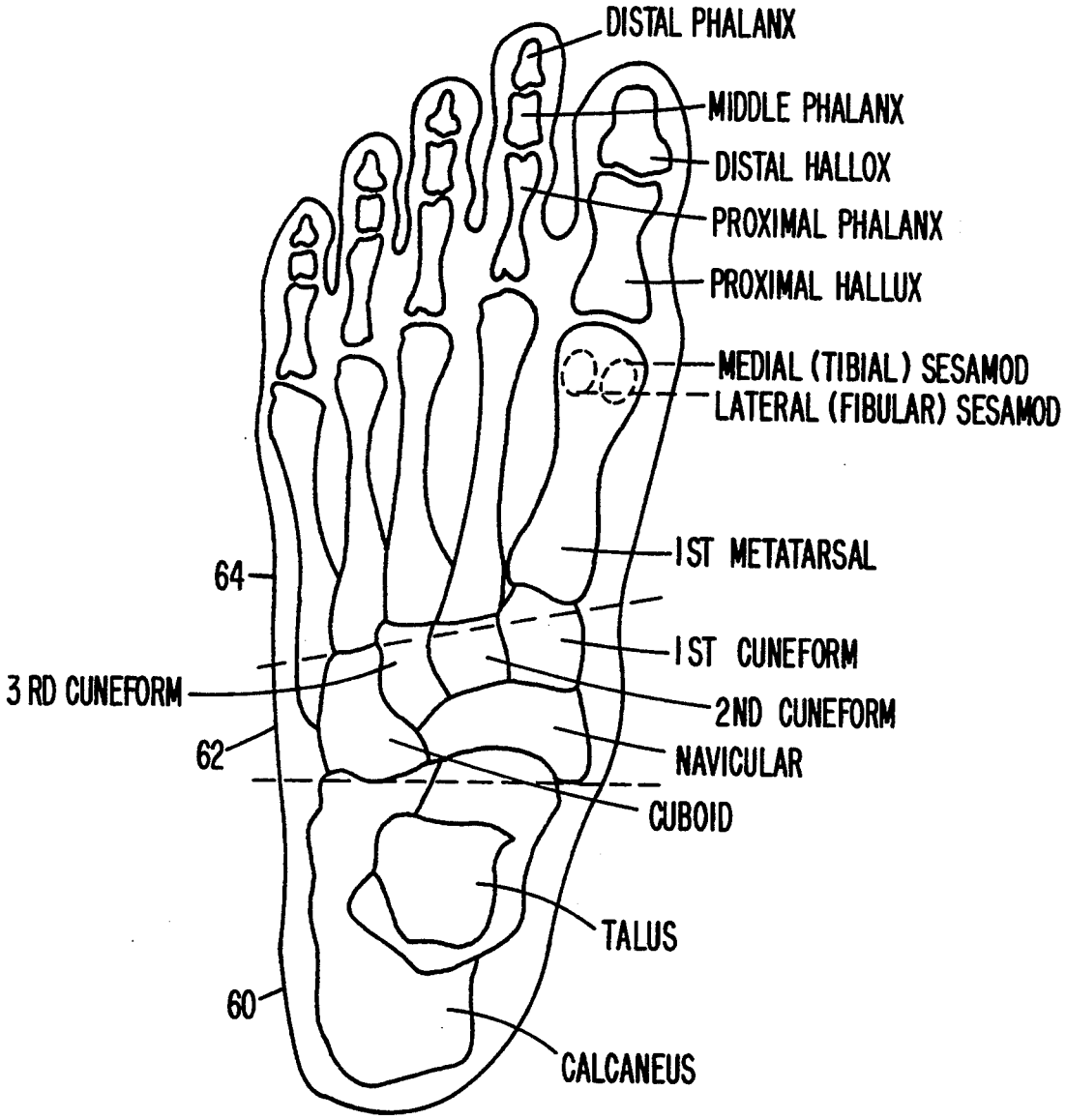
FIG. 10*b* is a dorsal view showing bones of the foot.

With reference to FIGS. 10*a* and 10*b*, a plantar and a dorsal view, respectively, of the bones of the foot are shown. For purposes of description, the dashed lines in the Figures approximately divide the foot into three distinct reference zones. Rearfoot zone 60, commonly known as the heel, substantially contains the talus and calcaneus, that is, rearfoot zone 60 extends from the rear of the foot to a location generally forward of the calcaneus and talus, and rearward of the navicular and cuboid. Midfoot zone 62, commonly known as the arch, substantially contains the navicular, cuboid and the first, second and third cuneiforms and a portion of the base of the lateral metatarsals, that is midfoot zone 62 extends from the border of rearfoot zone 60 to a location generally rearward of the metatarsal heads. Forefoot zone 64, commonly known as the ball and toe area substantially contains the five metatarsal heads, as well as the phalanges and sesmoids. That is, forefoot zone 64 extends from the border of midfoot zone 62 to the forward end of the foot. This division of the foot into three zones or portions must of course be an approximation due to the irregular shapes and partial overlap of some of the bones.

In a preferred embodiment of the invention, as shown in FIG. 1, cushioning and stability component 24 extends from the rear of the shoe to approximately the posterior border of the forefoot zone, that is, for about 50% of the length of the shoe. As shown in FIGS. 10*a* and 10*b*, in this embodiment cushioning and stability component 24 would be disposed in both rearfoot zone 60 and midfoot zone 62 of the shoe. This embodiment is useful for allowing the sole to flex at the metatarsal-phalangeal joint. In this embodiment, if the shoe were size 9 men's, the overall length of the shoe would be 29 cm and the length of cushioning and stability component 24 would be approximately 15 cm. The same proportions could be used for other size shoes. However, cushioning and stability component 24 could extend throughout only rearfoot zone 60. Alternatively, cushioning and stability component 24 could extend throughout the entire region between outsole 20 and upper 12 so as to include all of the rearfoot zone 60, midfoot zone 62 and forefoot zone 64, with layer 22 of conventional cushioning material completely eliminated, or disposed above only a portion of cushioning and stability element 24. This embodiment would be useful for extending the special cushioning properties of the present invention under the forefoot. Although only three embodiments of the cushioning component 24 are discussed, cushioning components which occupy any desired portion of the midsole area are within the scope of this invention.

In the present invention, adequate cushioning is provided without undesirably increasing the weight of the shoe. In a prior art shoe, where conventional polyurethane is used, 100% of the midsole will be filled with foam. By use of a midsole according to the present invention, leas than approximately 40% of the shell will be occupied by solid cushioning material. Thus, a correspondingly reduced percentage of the overall midsole area will be occupied by solid cushioning material. These figures are shown in TABLE C for four preferred embodiments, utilizing the embodiments of shell 26 disclosed in Table A. In TABLE C, the volumes are expressd in $cm^3$, with COLUMN representing the total volume of four hollow foam column elements 32; WEDGE representing the volume of midfoot wedge 40, INNER ELEMENT representing the volume of an inner air bladder such as bladder 344, SHELL representing the total volume enclosed by shell 26; and PERCENT representing the percent of the shell occupied by all of the elements disposed within, that is, the foam column, air bladder and the wedge.

TABLE C

| SIZE RANGE | M4–M6 W5½–W7½ | M6½–M8½ W8–W10 | M9–M11 W10½–W12½ | M11½–M15½ |
|---|---|---|---|---|
| COLUMN | 43.36 | 48.70 | 48.70 | 48.70 |
| INNER ELEMENT | 5.195 | 10.183 | 10.183 | 10.183 |
| WEDGE | 22.200 | 25.287 | 28.690 | 36.199 |
| SHELL | 184.867 | 210.575 | 238.913 | 301.442 |
| PERCENT | 38.27 | 40.01 | 36.69 | 31.57 |

As shown in TABLE C, all of the support elements together, along with the inner elements and the midfoot wedge occupy less than 60% of the volume defined by the shell. Thus, a correspondingly reduced percentage of the entire volume of the midsole is ooccupied by solid material (including air bladders), as compared to the prior art in which 100% of the same area would be occupied by conventional polyurethane. In the present invention, adequate cushioning would be provided in the desired range of stiffness with support elements 32 disposed so as to occupy between 5–50% of the volume of the space contained in the region defined between the inferior aspect of the shoe upper as defined by the lasting margin and the outsole or ground engaging member and including both the midfoot and rearfoot, that is, the space defined for cushioning component 24. Both the extent of the space between the upper and lower plates which is occupied by foam or other solid matter, and the extent to which the cushioning and stability component extends throughout the midsole region would be a design choice.

Figure 11A:
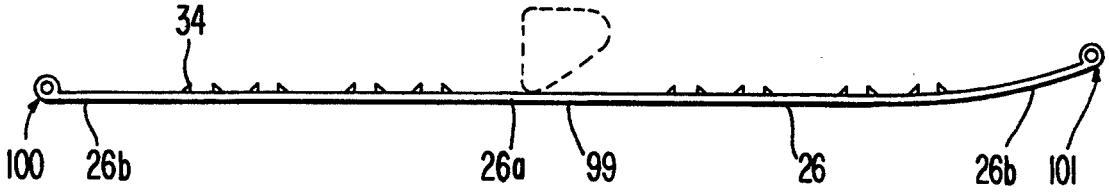
FIGS. 11*a*–11*d* show a method of assembly of a shell according to the invention.
Figure 11B:
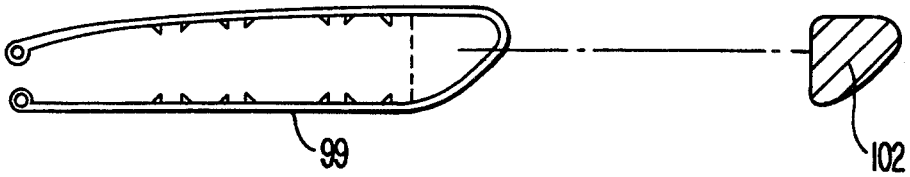
Figure 11C:
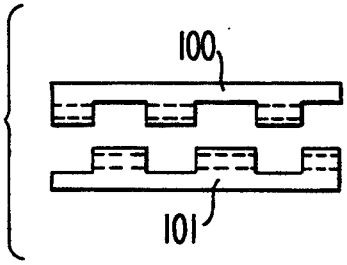

With reference to FIGS. 11*a*–11*d*, a method for assembly of one embodiment of cushioning and stability component 24 is shown. Shell 26 is molded as a nearly flat piece having a thin central region 26*a* and thicker end regions 26*b*. Detents 34 are formed on the surface of thin central region 26*a*. Regions 26*b* include hinge elements 100 and 101. Hinge element 100 is a hollow cylinder cut away to form hollow alternating steps which serve as pin holes, as shown in FIG. 11*c*. Hinge element 101 is also a hollow cylinder and includes corresponding alternating steps which mate with the steps of hinge element 100.

Figure 11D:
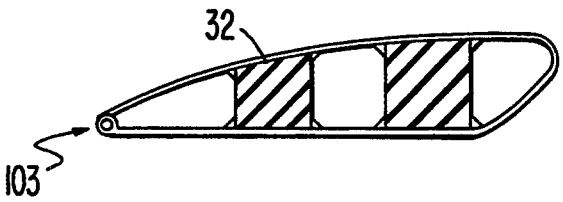

With reference to FIGS. 11*b*–11*c*, shell 26 is heated to a temperature which renders it soft so that it may be folded over steel forming element 102, which forms the rear portion of shell 26 into a desired curved shape and simultaneously brings hinge element 100 into a position adjacent hinge element 101. With reference to FIG. 11*d*, support elements 32 are secured into detents 34, for example, by cement, and hinge element 100 is brought into alignment with hinge element 101. A restraint 103, for example, a steel pin or metallic tube is pushed in place through the hollow alternating steps to secure the ends of shell 26 and thereby form a closed loop. If it is not desired that shell 26 have a closed loop, the last step of securing the hinge elements need not be performed.

The formation of shell 26 in the manner discussed above results in a shell having substantially one or both ends with a relatively large radius, that is, the ends are substantially rounded. This construction allows for unrestricted compressive motion of the support elements. If the shell were constructed to have ends which were less rounded, the result would be the formation of substantially planar vertical walls located near the support elements. This structure would undesirably alter the compressive characteristics of the support elements, as well as increase the stress on the shell itself and thus the possibility of failure. In order to reduce the possibility of failure, the material from which the shell is constructed would have to be stronger, adversely affecting the pattern of deflection of the support elements.

This invention has been disclosed with reference to the preferred embodiments. These embodiments, however, are merely for example only and the invention is not restricted thereto. It will be understood by those skilled in the art that other variations and modifications easily can be made within the scope of this invention as defined by the appended claims.

We claim:

1. A shoe having an upper and a sole connected to said upper, said sole including an outsole and a midsole, said midsole comprising a layer of resilient material and a substantially open space defined by an upper boundary and a lower boundary, a two-element cushioning component disposed within said open space between said upper boundary and said lower boundary and including a first compressible cushioning element made of a resilient material having an open space and a second compressible cushioning element comprising a pressurized bladder disposed within the open space of said first compressible element, an upper surface of said first compressible element secured at the location of said upper boundary, wherein, said open space between said upper boundary and said lower boundary is maintained substantially about said two-element cushioning component.

2. The shoe recited in claim 1, further comprising an upper plate disposed so as to define the upper boundary of the open space and a lower plate disposed so as to define the lower boundary of the open space, the upper surface of said first compressible element secured to said upper plate.

3. The shoe recited in claim 2, said first compressible element having a predetermined relaxed height which is substantially equal to the height of said open space between said upper plate and said lower plate, said bladder pressurized so as to have a height which exceeds said predetermined relaxed height and thereby causing said first compressible element to be stretched beyond said predetermined relaxed height.

4. The shoe recite in claim 2, said upper plate comprising a semi-rigid material.

5. The shoe recited in claim 1, said bladder containing a pressurized gas.

6. The shoe recited in claim 1, said bladder containing a gel.

7. The shoe recited in claim 1, said bladder containing a liquid.

8. The shoe recited in claim 1, said resilient material comprising an elastomeric foam material.

9. The shoe recited in claim 8, said foam material comprising a microcellular polyurethane.

10. A shoe having an upper and a sole connected to said upper, said sole including an outsole and a midsole, said midsole comprising a layer of resilient material and a substantially open space defined by an upper boundary and a lower boundary, a two-element cushioning component disposed within said open space between said upper boundary and said lower boundary and including a first compressible cushioning element comprising a pressurized bladder having an open space and a second compressible cushioning element comprising a resilient material disposed within the open space of said bladder, an upper surface of said second compressible element secured at the location of said upper boundary, wherein, said open space between said upper boundary and said lower boundary is maintained substantially about said two-element cushioning component.

11. The shoe recited in claim 10, said resilient material comprising an elastomeric foam material.

12. The shoe recited in claim 11, said foam material comprising a microcellular polyurethane.

13. The shoe recited in claim 10 further comprising an upper plate disposed so as to define the upper boundary of the open space and a lower plate disposed so as to define the lower boundary of the open space, the upper surface of said second compressible element secured to said upper plate.

14. The shoe recite in claim 13, said upper plate comprising a semi-rigid material.

15. The shoe recited in claim 13, said second compressible element having a predetermined relaxed height which is substantially equal to the height of said open space between said upper plate and lower plate, said bladder pressurized so as to have a height which exceeds said predetermined relaxed height and thereby causing said second compressible element to be stretched beyond said predetermined relaxed height.

16. The shoe recited in claim 13, said bladder containing a pressurized gas.

17. The shoe recited in claim 13, said bladder containing a gel.

18. The shoe recited in claim 13, said bladder containing a liquid.

* * * * *